US006170230B1

(12) United States Patent
Chudy et al.

(10) Patent No.: US 6,170,230 B1
(45) Date of Patent: Jan. 9, 2001

(54) MEDICATION COLLECTING SYSTEM

(75) Inventors: Duane S. Chudy, Lincolnshire, IL (US); Shoji Yuyama; Shigeru Sugimoto, both of Toyonaka (JP)

(73) Assignees: Automed Technologies, Inc., Vernon Hills, IL (US); Yuyama Mfg. Co., Ltd., Toyonaka (JP)

( * ) Notice: Under 35 U.S.C. 154(b), the term of this patent shall be extended for 0 days.

(21) Appl. No.: 09/205,861

(22) Filed: Dec. 4, 1998

(51) Int. Cl.[7] ..... B65B 19/18

(52) U.S. Cl. ..... 53/168; 53/238; 53/531; 53/544

(58) Field of Search ..... 53/493, 168, 238, 53/531, 544, 450; 221/73, 123, 129, 197

(56) References Cited

U.S. PATENT DOCUMENTS

Re. 35,743 3/1998 Pearson .
3,556,342 1/1971 Guerr .

(List continued on next page.)

FOREIGN PATENT DOCUMENTS

405085501 * 4/1993 (JP) ..... 53/168
8-145495 2/1997 (JP) .

OTHER PUBLICATIONS

U.S. application No. 08/650,971, Yuyama, filed Feb. 1998.
U.S. application No. 09/021,864, Yuyama, filed Feb. 1998.
ScriptPro Pharmacy Automation, "Automated Prescription Dispensing System," Dec. 1995 copyright notice indicates date of 1996.
Medical Packaging Inc., "AutoPakTM—A Fully Automated Unit Dose Packaging System" undated.
Baker APS, "Expand Your Pharmacy's Potential with the Total Automation Starter Kit from Baker APS" undated.
Innovation Associates, "PharmASSIST" undated.
Innovation Associates, "PharmASSIST Order Entry Manual Filling . . . " undated.
Tosho, "Tosho Main–Topra Series PC–Cat" undated in the English–language.
Baker APS, "Baker The Pharmacy Productivity Company—Pharmacy 1000" undated.
Sanyo, "AIC–RNC7/RNV7" undated in the English language.
Yuyama Mfg. Co., Ltd., "Yuyama Pharmaceutical Equipment General Catalog" date uncertain, possibly 1997 (see second page).
Yuyama Mfg. Co., Ltd., Yuyama catalog date uncertain, possibly 1995 (see second page).
Yuyama Mfg. Co., Ltd., Additional pages from the Yuyama Mfg. Co., Ltd. catalog "vol. 5" previously identified on the Mar. 25, 1999 IDC showing an ampule dispenser Date: Not later than Dec. 3, 1997, probably 1995 (see highlighted dates).

* cited by examiner

*Primary Examiner*—Eugene Kim
(74) *Attorney, Agent, or Firm*—Jansson, Shupe, Bridge & Munger Ltd.

(57) ABSTRACT

A medication dispensing apparatus of the present invention contains a plurality of different kinds of medication separately, dispenses the medicament to pack them into package belt, and discharges the package belt. The medication dispensing apparatus comprises a cutting device for cutting the package belt into short package belt including at least one medication package for specified period in accordance with prescription data, a stacking device for stacking the short package belts and a bundling device for bundling the stacked short package belts. According to the medication dispensing apparatus, it is possible to cut off medication packages and empty packages from the package belt automatically and rapidly, reducing medication distributing job in a hospital. The medication dispensing apparatus is applicable to a medicament collecting system comprising a tray feed station, a medication dispensing station and a tray recovering station.

14 Claims, 23 Drawing Sheets

U.S. PATENT DOCUMENTS 3,917,045 11/1975 Williams et al. .
3,998,356 12/1976 Christensen .
4,360,125 11/1982 Martindale et al. .
4,546,901 10/1985 Buttarazzi .
4,664,289 5/1987 Shimizu et al. .
4,733,362 3/1988 Haraguchi .
4,847,764 7/1989 Halvorson .
4,870,799 10/1989 Bergerioux et al. .
4,903,861 2/1990 Yuyama .
4,972,657 11/1990 McKee .
5,014,875 5/1991 McLaughlin et al. .
5,097,652 3/1992 Inamura et al. .
5,108,005 4/1992 Mosbacher .
5,208,762 5/1993 Charhut et al. .
5,233,813 * 8/1993 Kenney et al. ..... 53/450
5,253,783 10/1993 Freudelsperger .
5,292,029 3/1994 Pearson .
5,335,816 8/1994 Kaufman et al. .
5,337,919 8/1994 Spaulding et al. .
5,348,061 9/1994 Riley et al. .
5,377,864 1/1995 Blechl et al. .
5,401,059 3/1995 Ferrario .
5,431,299 7/1995 Brewer et al. .
5,460,294 10/1995 Williams .
5,481,855 1/1996 Yuyama .
5,528,882 * 6/1996 Yamamoto ..... 53/531
5,533,606 7/1996 Yuyama .
5,593,267 1/1997 McDonald et al. .
5,597,995 1/1997 Williams et al. .
5,604,692 2/1997 Yuyama .
5,648,751 7/1997 Yuyama et al. .
5,671,592 9/1997 Yuyama et al. .
5,678,393 10/1997 Yuyama et al. .
5,704,516 1/1998 Yuyama .
5,709,063 1/1998 Yuyama et al. .
5,713,485 2/1998 Liff et al. .
5,713,487 2/1998 Coughlin .
5,720,154 2/1998 Lasher et al. .
5,722,215 3/1998 Yuyama .
5,758,095 5/1998 Albaum et al. .
5,761,877 6/1998 Quandt .
5,762,235 6/1998 Coughlin .
5,765,606 6/1998 Takemasa et al. .
5,771,657 * 6/1998 Lasher et al. ..... 53/168
5,787,678 8/1998 Koike et al. .
5,798,020 8/1998 Coughlin et al. .
5,800,113 9/1998 Yuyama et al. .
5,803,309 9/1998 Yuyama et al. .
5,810,061 9/1998 Yuyama .
5,819,500 10/1998 Haraguchi et al. .
5,832,693 11/1998 Yuyama et al. .
5,838,245 11/1998 Murakami et al. .
5,839,257 * 11/1998 Soderstrom et al. ..... 53/168
5,839,836 11/1998 Yuyama et al. .
5,852,911 12/1998 Yuyama et al. .
5,852,971 12/1998 Yuyama et al. .
5,862,942 1/1999 Yuyama et al. .
5,875,610 * 3/1999 Yuyama et al. ..... 53/168
5,946,883 * 9/1999 Yuyama et al. ..... 53/168

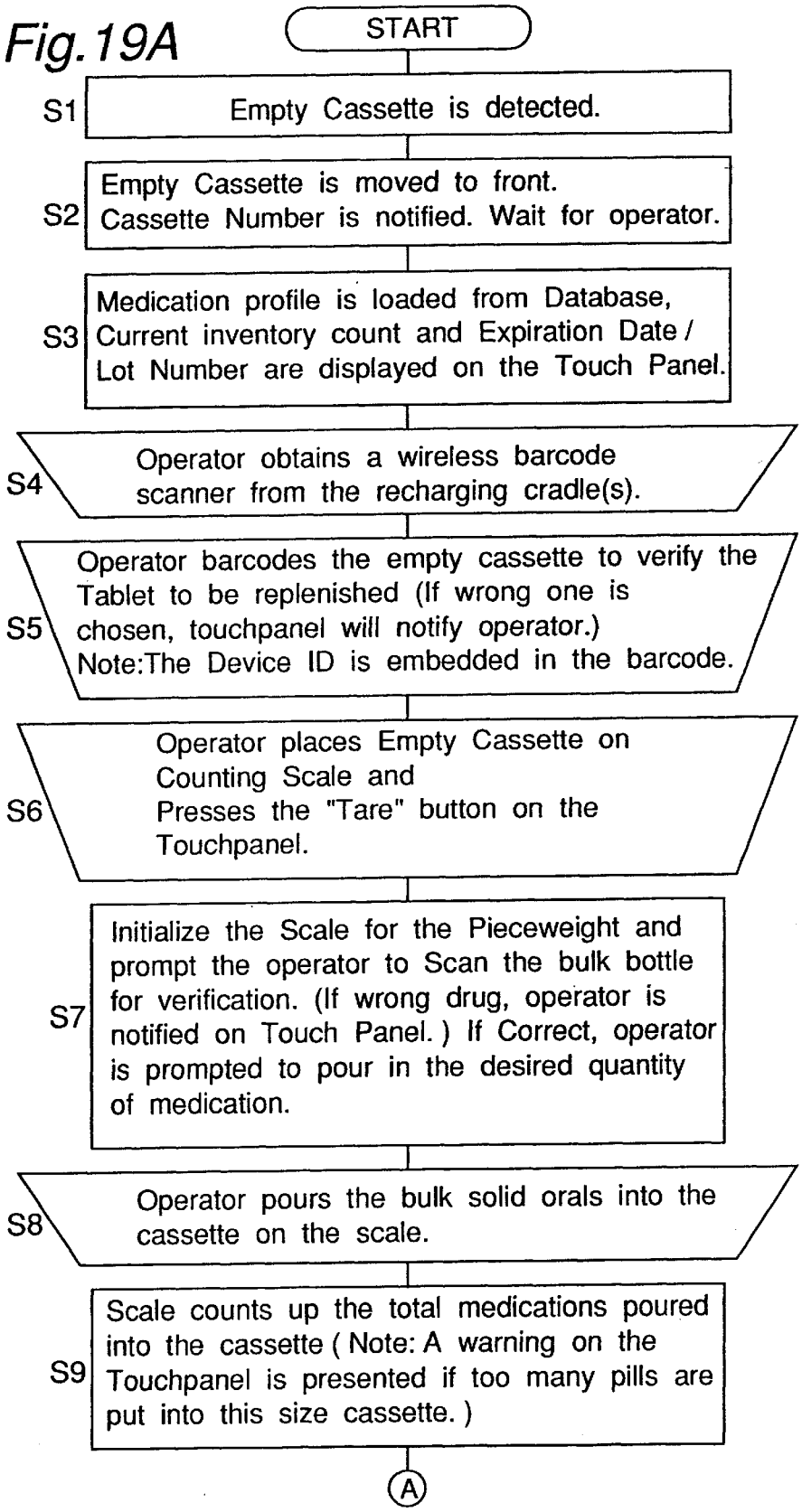
Fig. 19A
START
S1
Empty Cassette is detected.
S2
Empty Cassette is moved to front.
Cassette Number is notified. Wait for operator.
S3
Medication profile is loaded from Database,
Current inventory count and Expiration Date /
Lot Number are displayed on the Touch Panel.
S4
Operator obtains a wireless barcode
scanner from the recharging cradle(s).
S5
Operator barcodes the empty cassette to verify the
Tablet to be replenished (If wrong one is
chosen, touchpanel will notify operator.)
Note:The Device ID is embedded in the barcode.
S6
Operator places Empty Cassette on
Counting Scale and
Presses the "Tare" button on the
Touchpanel.
S7
Initialize the Scale for the Pieceweight and
prompt the operator to Scan the bulk bottle
for verification. (If wrong drug, operator is
notified on Touch Panel.) If Correct, operator
is prompted to pour in the desired quantity
of medication.
S8
Operator pours the bulk solid orals into the
cassette on the scale.
S9
Scale counts up the total medications poured
into the cassette ( Note: A warning on the
Touchpanel is presented if too many pills are
put into this size cassette. )
A

MEDICATION COLLECTING SYSTEM

FIELD OF THE INVENTION

The present invention relates to a medication dispensing apparatus which contains a plurality of different kinds of medication (in this application the terms medication and medicament are used interchangeably) separately, dispenses the medicament to pack them into a package belt, and discharges the package belt, as well as a medication collecting system in which a medication dispensing station comprising the medication dispensing apparatus is disposed along a conveyor line and by which medication discharged from the medication dispensing station is placed onto a tray conveyed along the conveyor line and then collected.

BACKGROUND OF THE INVENTION

It is an idea disseminated in the 1960s in Japan that medication may be packaged in dosages and delivered to patients. This idea has been put into practical use mainly as packaging machines for powdered medicines. Tablet machines were developed in 1970s, and ampoule dispensing machines were developed in 1990s. These machines have been used in different ways according to their respective proper applications.

U.S. Pat. No. 5,604,692 discloses an apparatus in which a plurality of preparation stations classified according to the type of medication are arranged along a conveyor line and in which medicaments prepared at the individual preparation stations are collected to a checking station by the conveyor line. This apparatus prepares medicaments for the time period described in the prescription and delivers the medicaments to the patient.

In recent years, there has been developed an idea that medicaments prescribed to one patient are all collected regardless of the type of medicament and provided to the patient. This idea has been put into U.S. patent application Ser. No. 09/021864, the assignee of which is the same as one of the assignees of the present application.

In America, medicaments for one-day doses to be administered to inpatients are a packaged box in the dispensary, and the box is stored in a movable medication storage cabinet, for example, MEDSTATION marketed by Pyxis Co. With the medication storage cabinet provided in the nurse station, when the medicament administration time comes, medicaments are taken out from the medication storage cabinet and administered to patients. Upon completion of the medicament administration for one-day doses, the medication storage cabinet is returned to the dispensary medication storage cabinet in which medicaments for the next day have been stored is then moved to the nurse station. By adopting such a system, clear histories of administration to the patients can be obtained, allowing accounting, medicament inventory management and the like to be carried out collectively.

However, medicaments, particularly tablets, for one-day doses are packaged in the form of a continuous package belt. The package belt comprises a medication package portion in which one dose of tablet is packed, a print portion in which patient information, medicament information, dosage information and the like are printed, and an empty package portion which is inserted between different patients. This package belt arrangement necessitates troublesome work such as separating off medication packages for each patient or for each dose, or cutting off empty packages. In particular, in the case of, for example, medicaments to be ordered in operation rooms, CPUs, or emergency departments, it is desired that such work as the separation of medication packages and the cutoff of empty packages be achieved promptly for subsequent delivery of the medicaments.

SUMMARY OF THE INVENTION

The present invention having been accomplished in view of these and other problems, an object of the invention is to provide a medication collecting system which is capable of automatically and promptly achieving the separation of medication packages in the medication package belt and the cutoff of empty packages.

In order to achieve the above object, the present invention provides a medication dispensing apparatus which contains a plurality of different kinds of medication separately, dispenses the medicament to pack them into package belt, and discharges the package belt, comprising:

cutting means for cutting the package belt into shortened package belts including at least one medication package for a specified period in accordance with prescription data;

stacking means for stacking the short package belts; and bundling means for bundling the stacked short package belts.

The present invention also provides a medication collecting system, comprising:

a tray feed station for accumulating a plurality of empty trays and feeding the trays to a conveyor line;

a medication dispensing station for containing a plurality of different kinds of medication separately, dispensing the medicament to pack them into package belt, and discharging the package belt into the tray fed to the conveyor line from the tray feed station; and a tray recovering station for recovering the tray containing the package belt discharged from the medication dispensing station and for sorting the trays;

wherein the medication dispensing station comprises;

cutting means for cutting the package belt into shortened package belts including at least one medication package for a specified period in accordance with prescription data;

stacking means for stacking the short package belts; and bundling means for bundling the stacked short package belts.

With the medication dispensing apparatus and the medication collecting system having the above constitutions, the separation of medication packages in the medication package belt and the cutoff of empty packages can be achieved automatically and promptly so that medication delivery work in the hospital can be reduced.

Preferably, the cutting means cuts the package belt into short package belts including medication packages taken at a day or at a time. Also, preferably, the short package belt cut by the cutting means includes at least one printed empty package and at least one medication package. Further, preferably, the cutting means cuts the empty package included in the package belt and the stacking means stacks the short package belts excluding the empty package.

Preferably, the medication dispensing station further includes: separating means for separating empty packages from the bundled short package belts; and means for putting the bundled short package separated by the separating means into the tray fed to the conveyor line.

The medication collecting system may further comprise a liquid medication dispensing station for containing a plurality of different kinds of liquid medication or ampoules separately, dispensing the liquid medicament, and discharging the liquid medicament into the tray fed to the conveyor line from the tray feed station.

BRIEF DESCRIPTION OF THE DRAWINGS

The following description of an embodiment of the present invention is carried out with reference to the accompanying drawings, in which:

FIGS. 19A and 19B are flow charts showing the tablet replenishing work in the tablet dispensing station;

DETAILED DESCRIPTION OF THE PREFERRED EMBODIMENT

Figure 1:
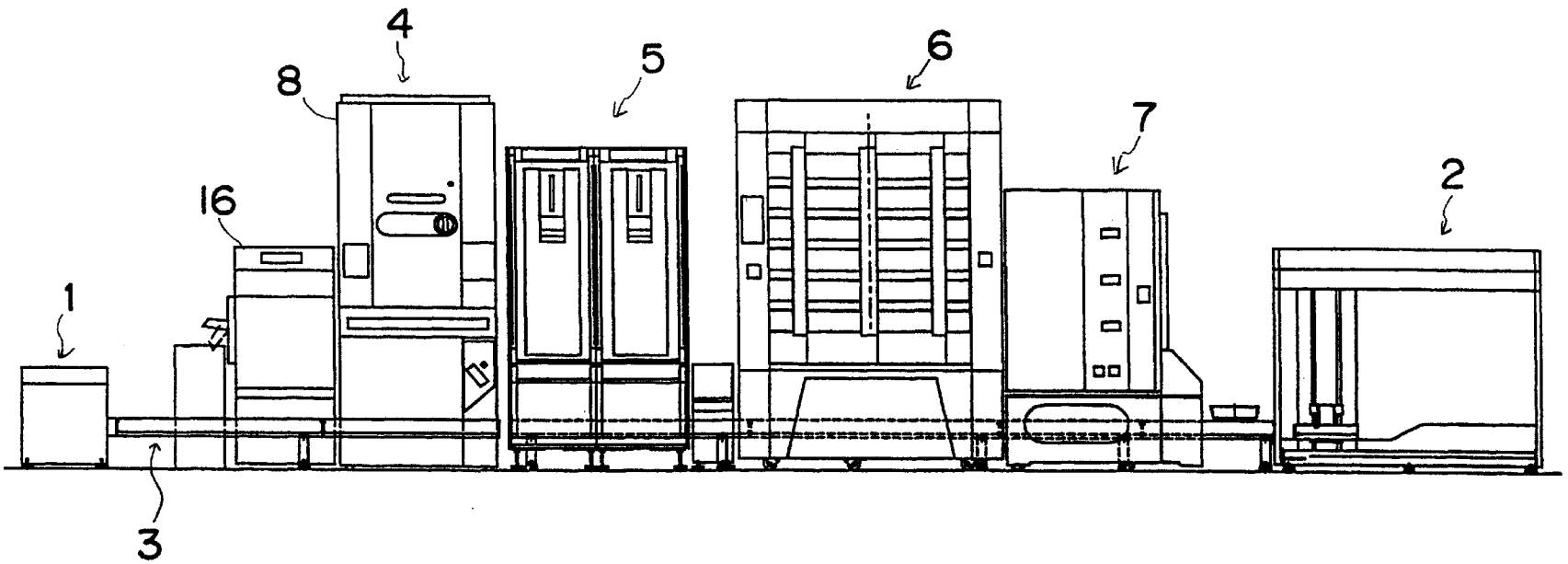
FIG. 1 is a schematic view of a medication collecting system according to the embodiment of the invention.

FIG. 1 shows a medication collecting system according to the present embodiment.

In this medication collecting system, a tablet dispensing station 4, an array ampoule dispensing station 5, a random ampoule dispensing station 6 and a label issuing station 7 are disposed one after another along a conveyor line 3 that connects a tray feed station 1 and a tray recovering station 2 to each other.

<Tray Feed Station>

Figure 2A:
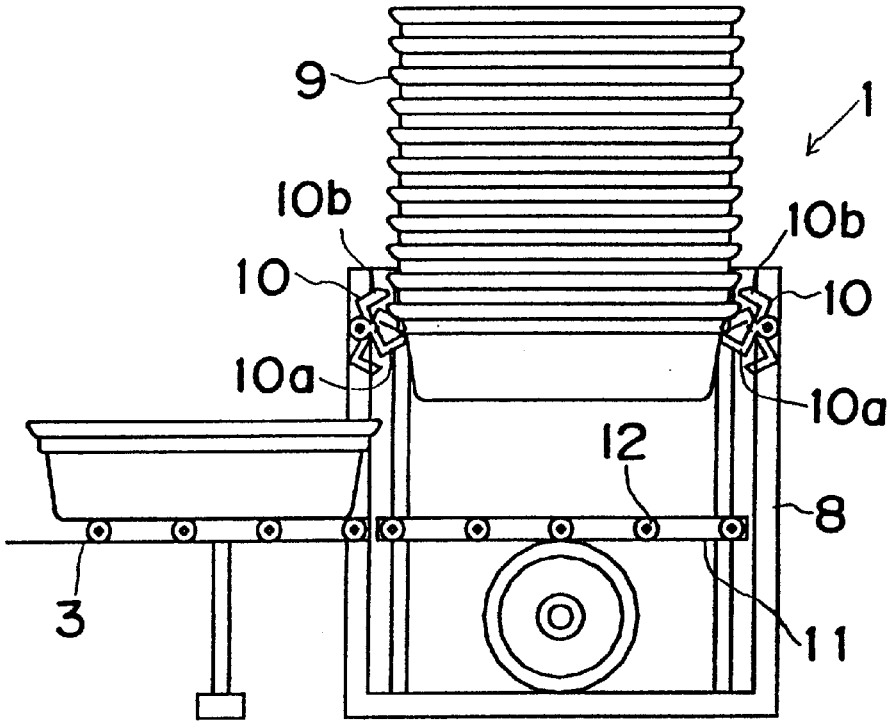
FIG. 2A is a front view of an initial state showing the tray discharging structure of the tray feed station.
Figure 2B:
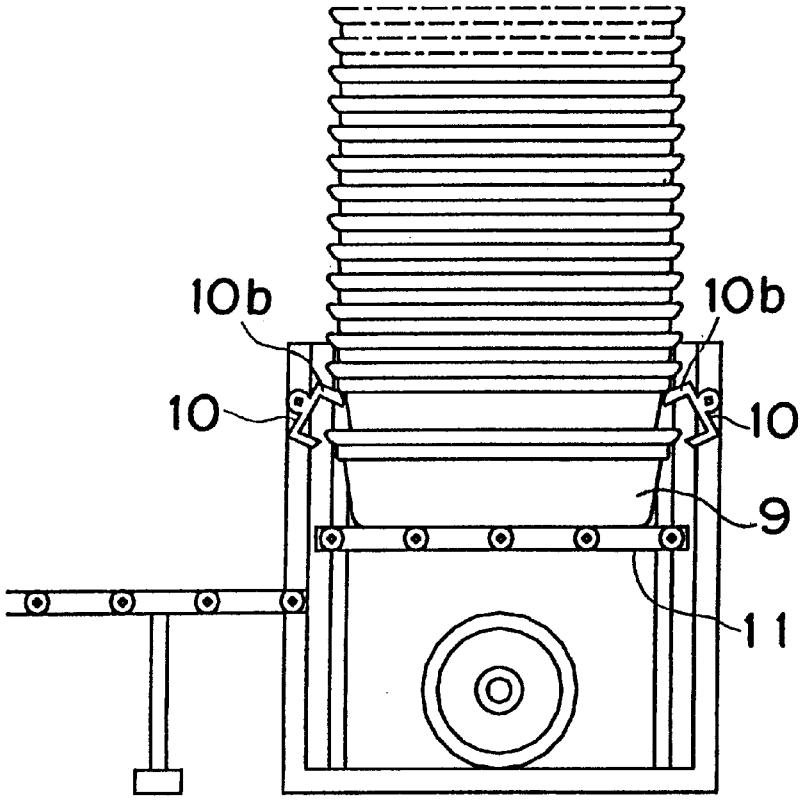
FIG. 2B is a front view showing a state in which the lowermost tray is discharged.

The tray feed station 1, in which a plurality of trays 9 are stored in a stacked state within a cylindrical housing 8 having a rectangular cross section as shown in FIG. 2A, is enabled to feed out the trays 9 one by one. The housing 8 has, on its opposite sides, support feed claws 10 which are pivoted by an unshown motor or the like, respectively. The support feed claws 10 support peripheries of the lowermost tray 9 by their lower claw portions 10*a* and, by pivoting, place the lowermost tray 9 onto a feed-out plate 11 located below the lowermost tray 9. During this process, the support feed claws 10 support peripheries of the next tray 9 by their upper claw portions 10*b* as shown in FIG. 2B, thereby making it possible to take out only the lowermost tray 9. In addition, the support feed claws 10, after taking out the lowermost tray 9, return to the original position and support the next tray 9 by their lower claw portions 10*a*. The feed-out plate 11, which is guided by a lower opposite face of the housing 8, can be moved up and down by a motor or the like. This feed-out plate 11 has a plurality of rotation-drivable rollers 12 provided in parallel. In the lower operating position, the feed-out plate 11 is enabled to transversely convey the tray 9 placed through a lower opening of the housing 8 and feed out the tray 9 to the conveyor line 3.

<Tablet Dispensing Station>

Figure 3:
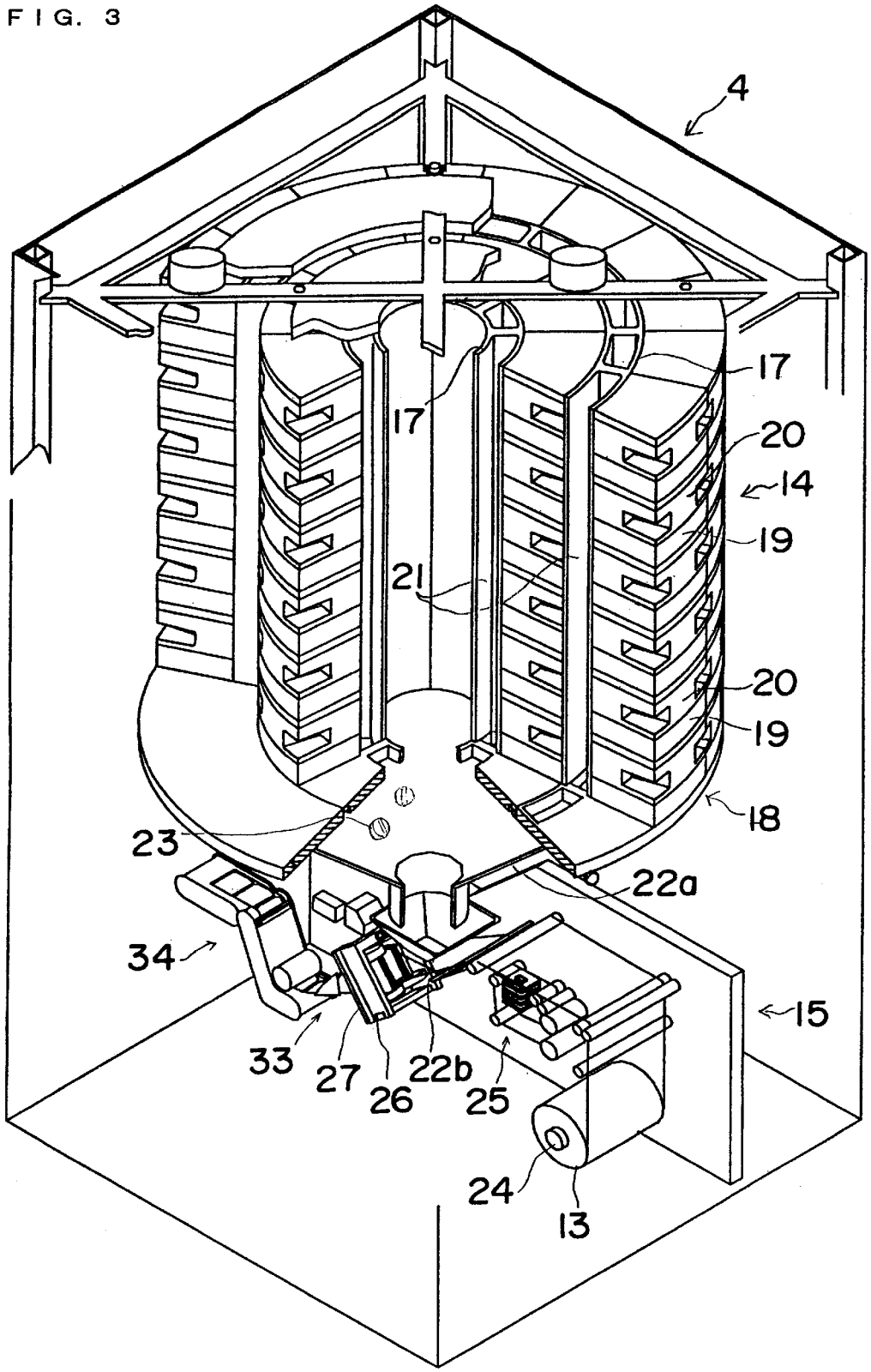
FIG. 3 is a partly broken perspective view showing the tablet dispensing station of FIG. 1.

The tablet dispensing station 4, which is provided to pack tablets 23 into a strip-shaped package belt 13 in doses, comprises a tablet feed section 14, a printing and packaging section 15 and a package-belt bundling section 16 (FIG. 1) as shown in FIG. 3.

The tablet feed section 14 comprises a cylindrical drum 18 equipped with tablet guide parts 17 being doubled inside and outside and extending up and down, a plurality of motor bases 19 disposed vertically and circumferentially on outer periphery of each tablet guide part 17, and a plurality of tablet cassettes 20 removably attached to the motor bases, respectively. Each tablet guide part 17 is divided circumferentially for each column of the vertically arrayed motor bases 19 and tablet cassettes 20, by which a tablet guide passage 21 extending vertically is formed. Below the cylindrical drum 18, are disposed hoppers 22*a*, 22*b*, which make it possible to collect tablets 23 dropping via the tablet guide passages 21 to one place.

In the tablet cassettes 20, different types of tablets 23 are stored, respectively, and tablets 23 amounting to one-day doses are discharged in units of one dose based on prescription information. The discharged tablets 23 are counted by sensors (not shown) provided on the motor bases 19, and fed to the printing and packaging section 15 via the hoppers 22 through the tablet guide passages 21. The number of tablets left in a tablet cassette 20 can be counted based on the number of initial storage number and the count number by the sensor, allowing a decision as to whether or not the tablets are lacking.

The printing and packaging section 15 comprises a roll 24 on which the package belt is wound, a printing part 25 for printing specified information on the surface of the package belt 13, a sealing part 26 for sealing the package belt 13 in doses, and a cutter part 27 for cutting the package belt 13 into specified lengths.

Figure 4:
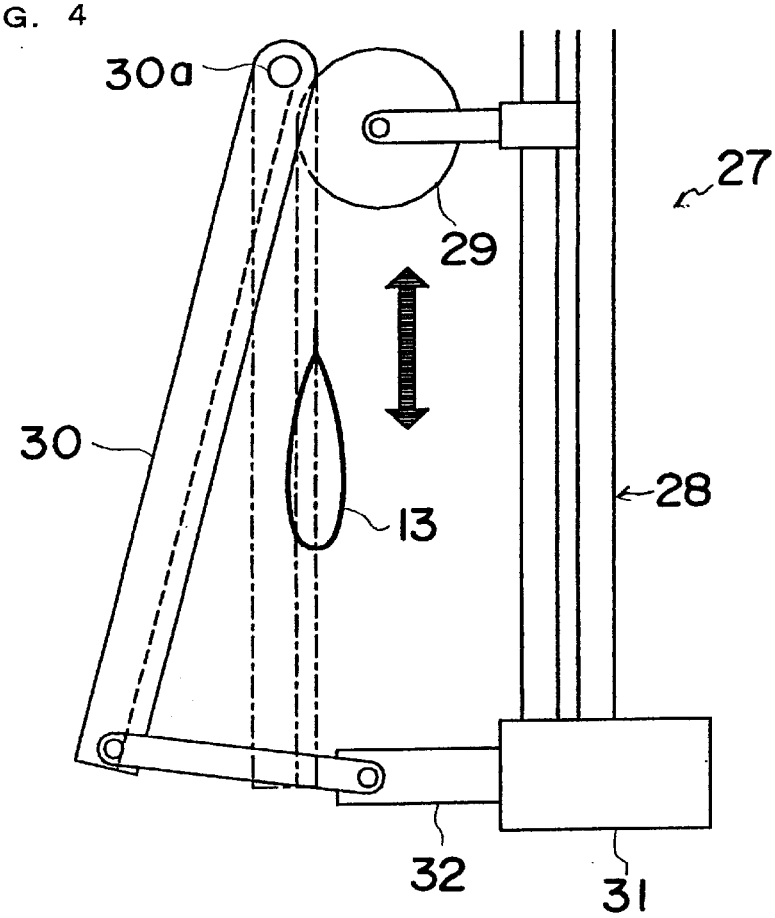
FIG. 4 is a front view showing the cutter part of FIG. 3.

The cutter part 27, as shown in FIG. 4, comprises a circular cutter 29 provided so as to be movable up and down along a guide shaft 28, and a pivotable cutter guide 30 which has a guide recess for guiding the peripheral cutting edge of the cutter 29 and which is pivotable about a pivot 30*a* provided at an upper end. A rod 32 of a solenoid 31 is coupled to a lower end portion of the cutter guide 30 so that the cutter guide 30 can be put into adjacency to the package belt 13, facilitating the cutting by the cutter 29.

The package-belt bundling section 16 is provided to bundle and bind the package belt 13 cut by the cutter 29. To this package-belt bundling section 16, the package belt 13 is fed via a direction changing part 33 and a conveyor 34.

Figure 5:
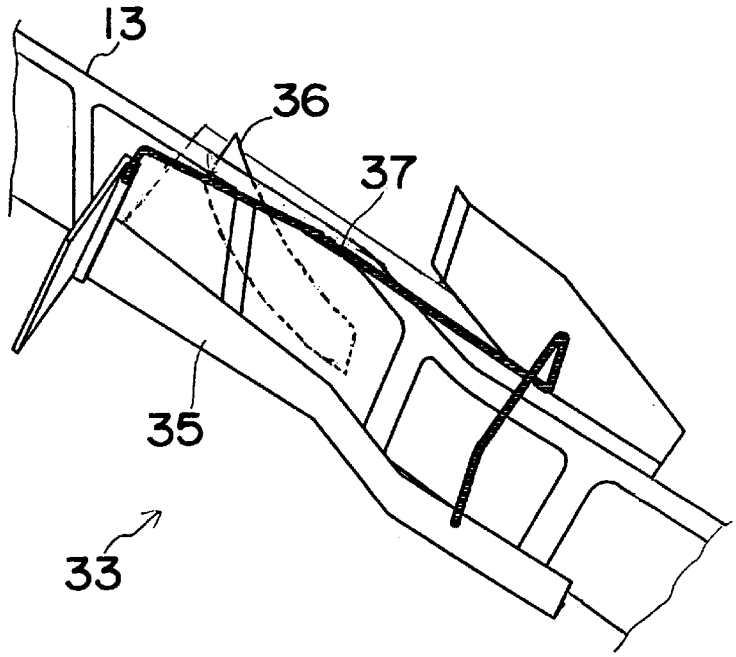
FIG. 5 is a perspective view showing the direction changing part of FIG. 3.

The direction changing part 33, as shown in FIG. 5, is provided to turn the cut package belt 13 approximately 90 degrees (from generally vertical to generally horizontal) while conveying the package belt 13 in the direction of arrow. This direction changing part 33 comprises a guide member 35 for guiding the package belt 13, a guide plate 36 for guiding the lower edge of the package belt 13 to the guide member 35, and a wire 37 for gradually engaging the upper edge of the package belt 13 to turn the package belt 13 sideways.

Figure 6:
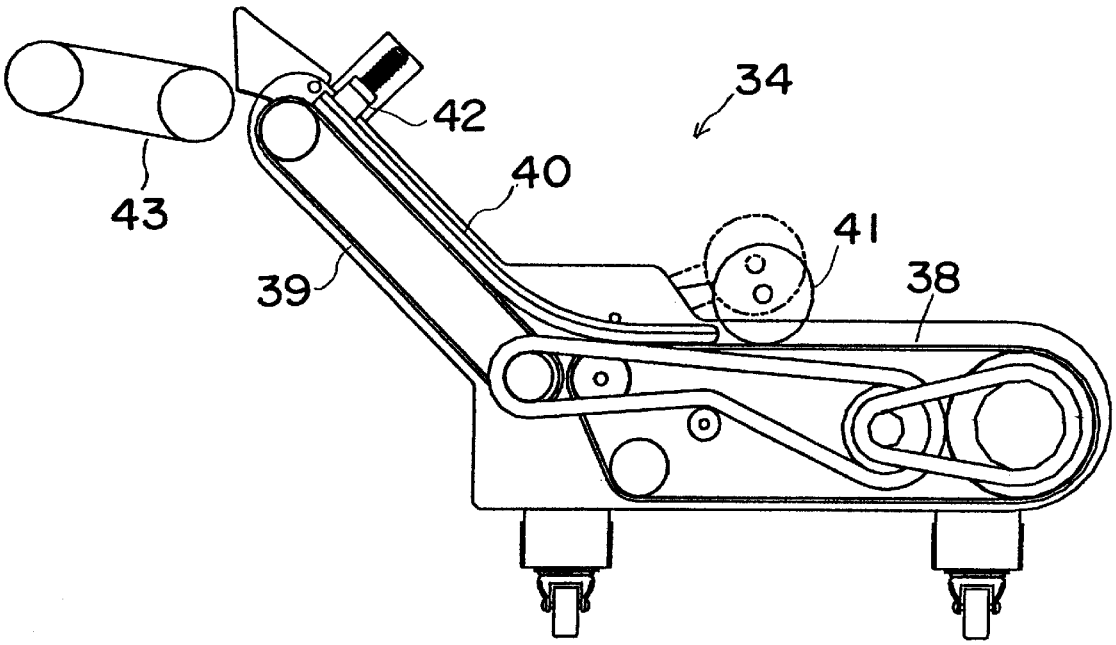
FIG. 6 is a front sectional view showing the conveyor of FIG. 3.

The conveyor 34, as shown in FIG. 6, is enabled to convey the package belt 13 obliquely upward by a horizontal conveyor belt 38 and a sloped conveyor belt 39. A tension sheet 40 is disposed above part of the horizontal conveyor belt 38 and the sloped conveyor belt 39. This tension sheet 40 is formed of a flexible material having small frictional resistance. A sponge roller 41 is disposed up-and-down swingably on the entrance side of an insertion passage defined by the belt 38 and the tension sheet 40. The belt 38 being set to a conveyance speed higher than that in the direction changing part 33. If an unreasonable tensile force should act upon the package belt 13, an unshown limit switch is turned off by the swinging movement of the sponge roller 41 so that the driving of the belt 38 is stopped. Meanwhile, on the exit side of the insertion passage, a presser member 42 biased by a spring is provided, biasing the tension sheet 40 toward the belt 39. As a result, the package belt 13 is pressed against the belt 38 with the frictional resistance increased, so that the package belt 13 can be prevented from clogging on the exit side. In addition, reference numeral 43 denotes a delivery belt for delivering the package belt 13 to the package-belt bundling section 16.

Figure 7:
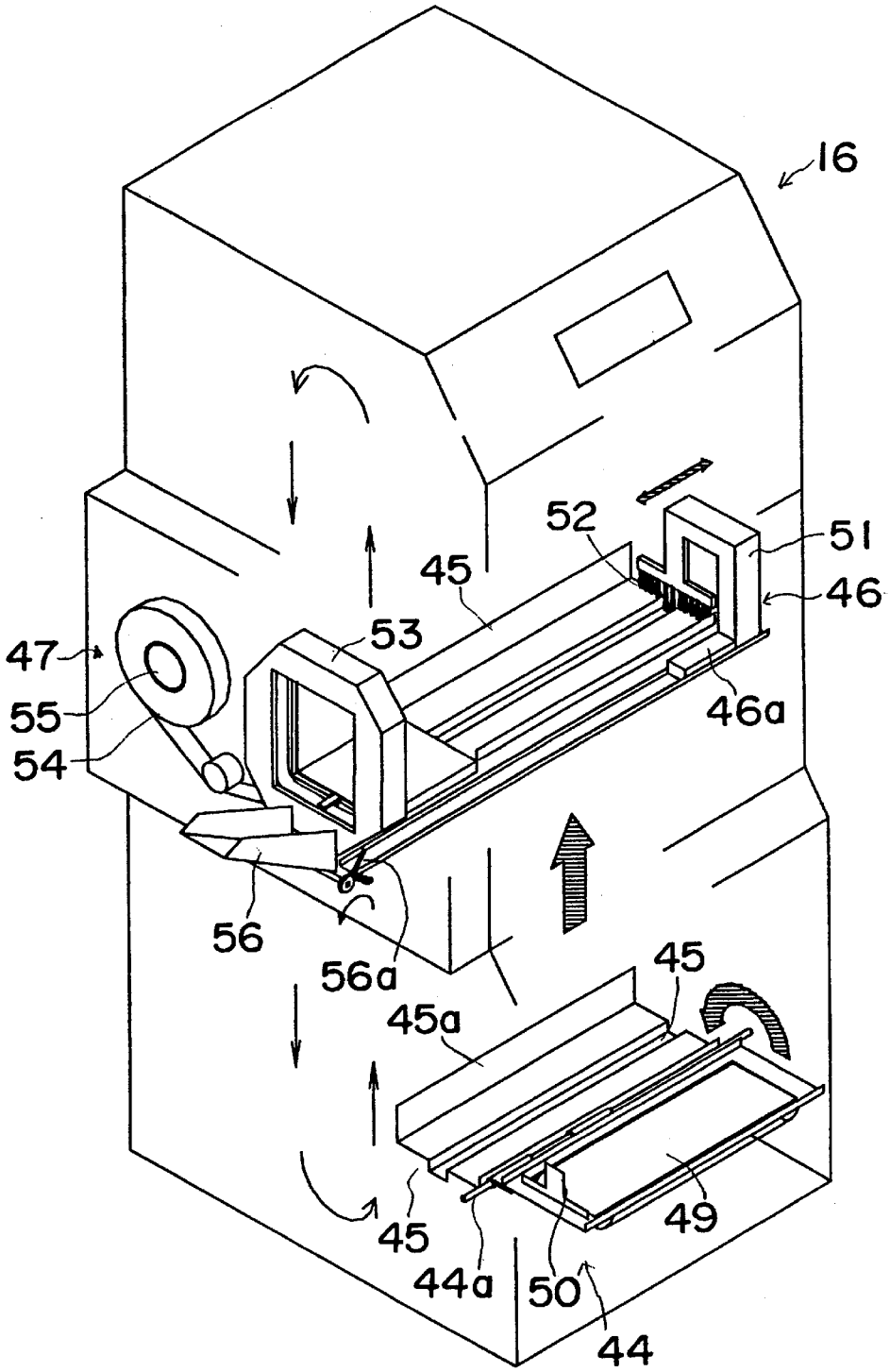
FIG. 7 is a perspective view showing the package-belt bundling section of FIG. 1.
Figure 8:
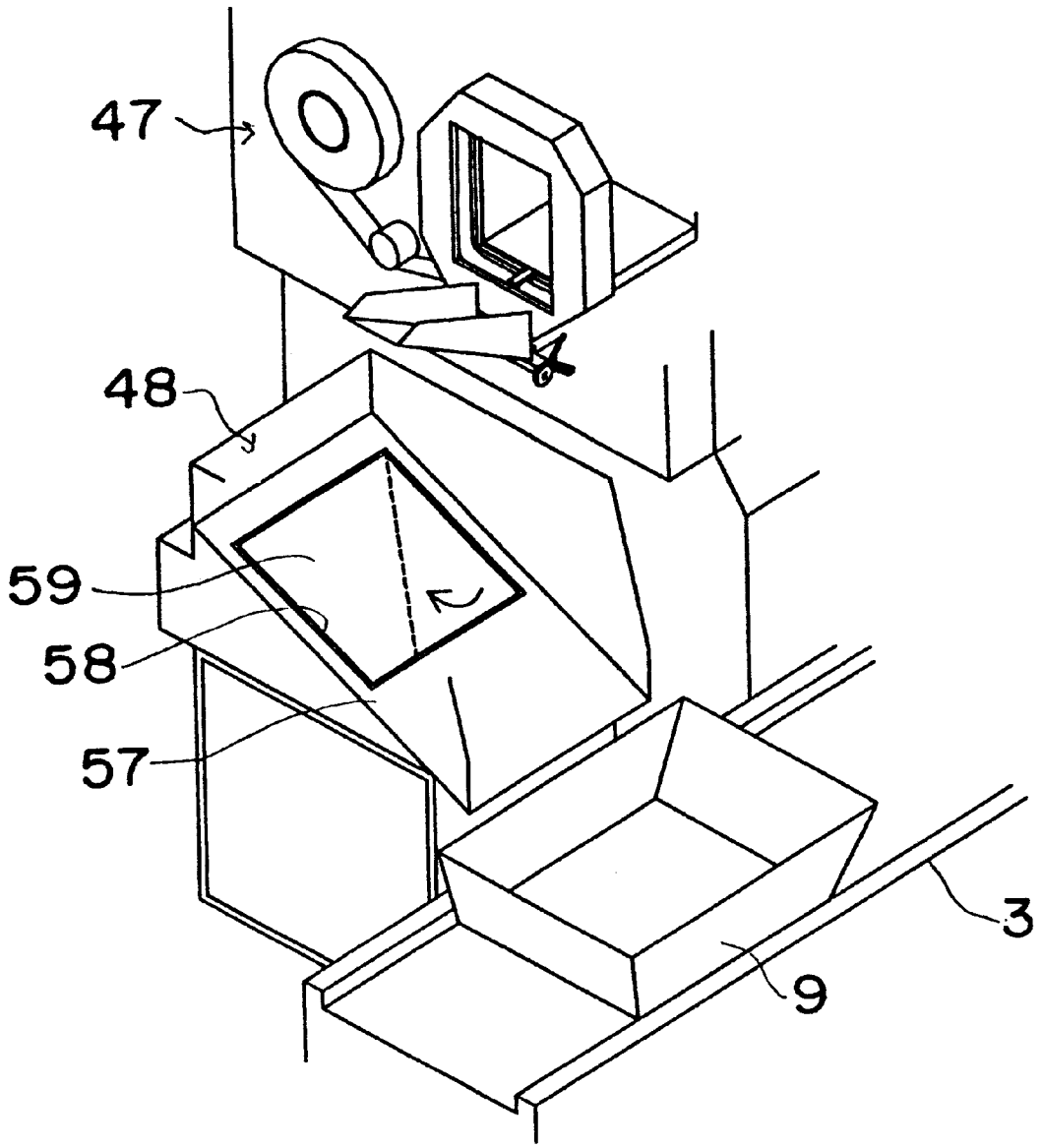
FIG. 8 is a perspective view showing the distributing member of FIG. 7.

The package-belt bundling section 16, as shown in FIGS. 7 and 8, comprises an inverting member 44, a lifter 45, a feed-in member 46, a bundling machine 47 and a distributing member 48.

The inverting member 44 is supported so as to be reciprocatively pivotable over a range of approximately 180 degrees about a support shaft 44*a*. This inverting member 44 comprises a pull-in conveyor 49 for pulling in the package belt 13 from the delivery belt 43. A stopper 50 for positioning the conveyed-in package belt 13 is protrusively provided at an end portion of the pull-in conveyor 49. A sensor (not shown) is provided in proximity to the stopper 50 so that the presence or absence of the package belt 13 can be detected.

The lifter 45 is plate-shaped and has a side wall 45*a* extending along both side edge portions, and a recess 45*b* extending longitudinally in a central portion. The lifter 45 is reciprocatively moved between a lower position where the package belt 13 inverted by the inverting member 44 can be loaded, and an upper position where the package belt 13 can be conveyed to the bundling machine 47 by the feed-in member 46.

The feed-in member 46 has a brush 52 provided at an end of a feed-in arm 51 that reciprocatively moves along the side portion 45*a* of the lifter 45 located in the upper position.

The bundling machine 47 comprises a looped rectangular frame body 53, and a roller 55 on which bundling tape 54 is wound, where central part of the stacked package belt 13 can be bundled with the tape 54 unwound from the roller 55. A chute 56 is provided in proximity to the bundling machine 47. This chute 56 has a tip end directed obliquely upward, and a presser 46*a* of the feed-in member 46 presses a lever 56*a*, by which the chute 56 is pivoted and directed obliquely downward.

Figure 9:
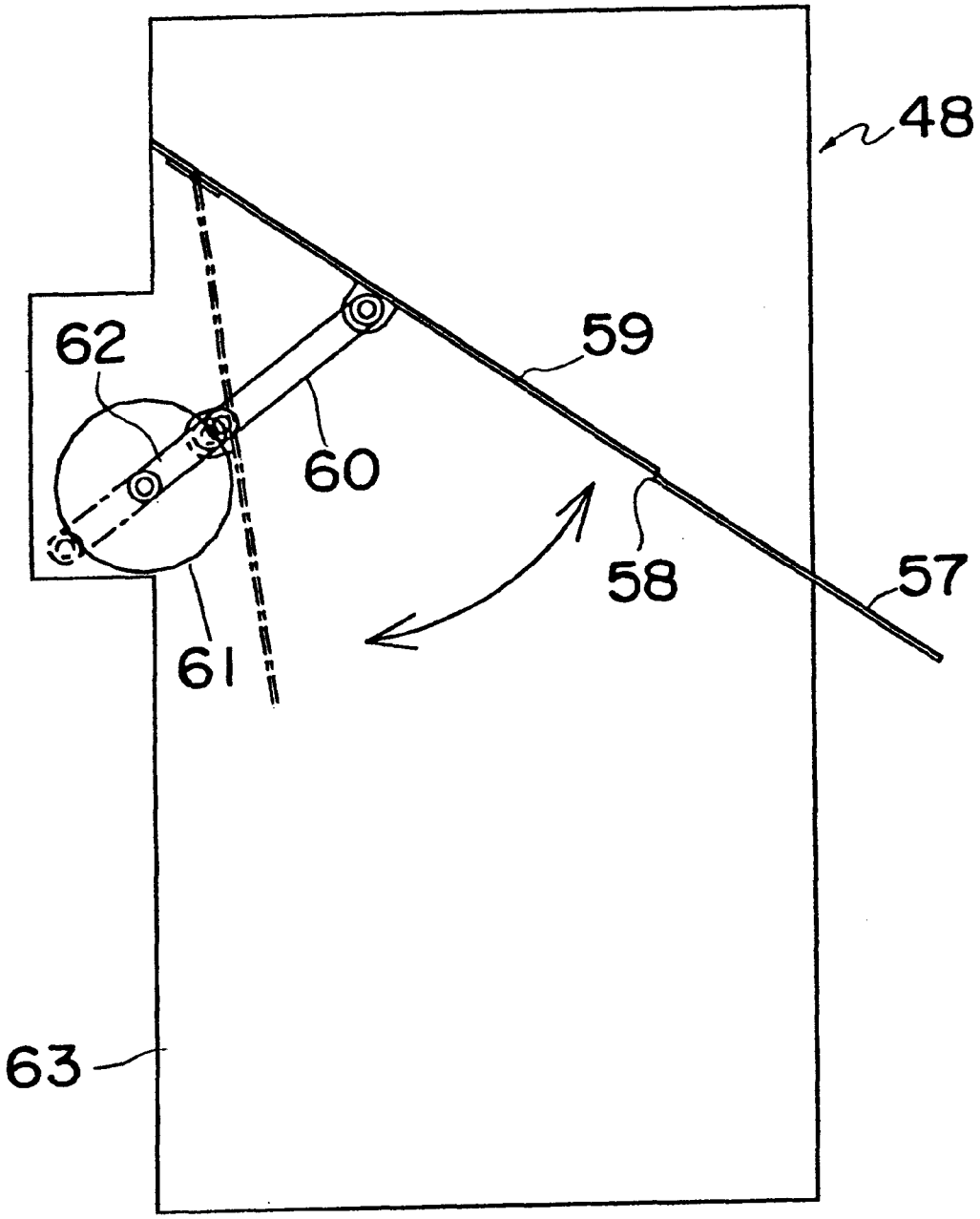
FIG. 9 is a side sectional view of FIG. 8.

The distributing member 48, as shown in FIG. 8, has an opening 58 formed in a sloped plate 57 directed obliquely downward, and this opening 58 is opened and closed by a distributing plate 59. A lower end edge of the sloped plate 57 extends to the conveyor line 3, allowing the bundled package belt 13 to be accommodated in the tray 9. Also, a first link 60 is pivotably coupled at its one end portion to the distributing plate 59 as shown in FIG. 9. A second link 62 provided on the rotating shaft of a motor 61 is pivotably coupled to the other end portion of the first link 60. The motor 61 is so designed as to stop every 180 degree rotation. As a result of this, the distributing plate 59 is pivotable between one position where the distributing plate 59 is aligned with the sloped plate 57 with the lower edge slightly out of alignment with the top surface, and another position where the distributing plate 59 is positioned generally vertical. Also, a dust box 63 is disposed below the opening 58 of the sloped plate 57, so as to collect unnecessary portions (empty packages) of the package belt 13.

<Array Ampoule Dispensing Station>

Figure 10:
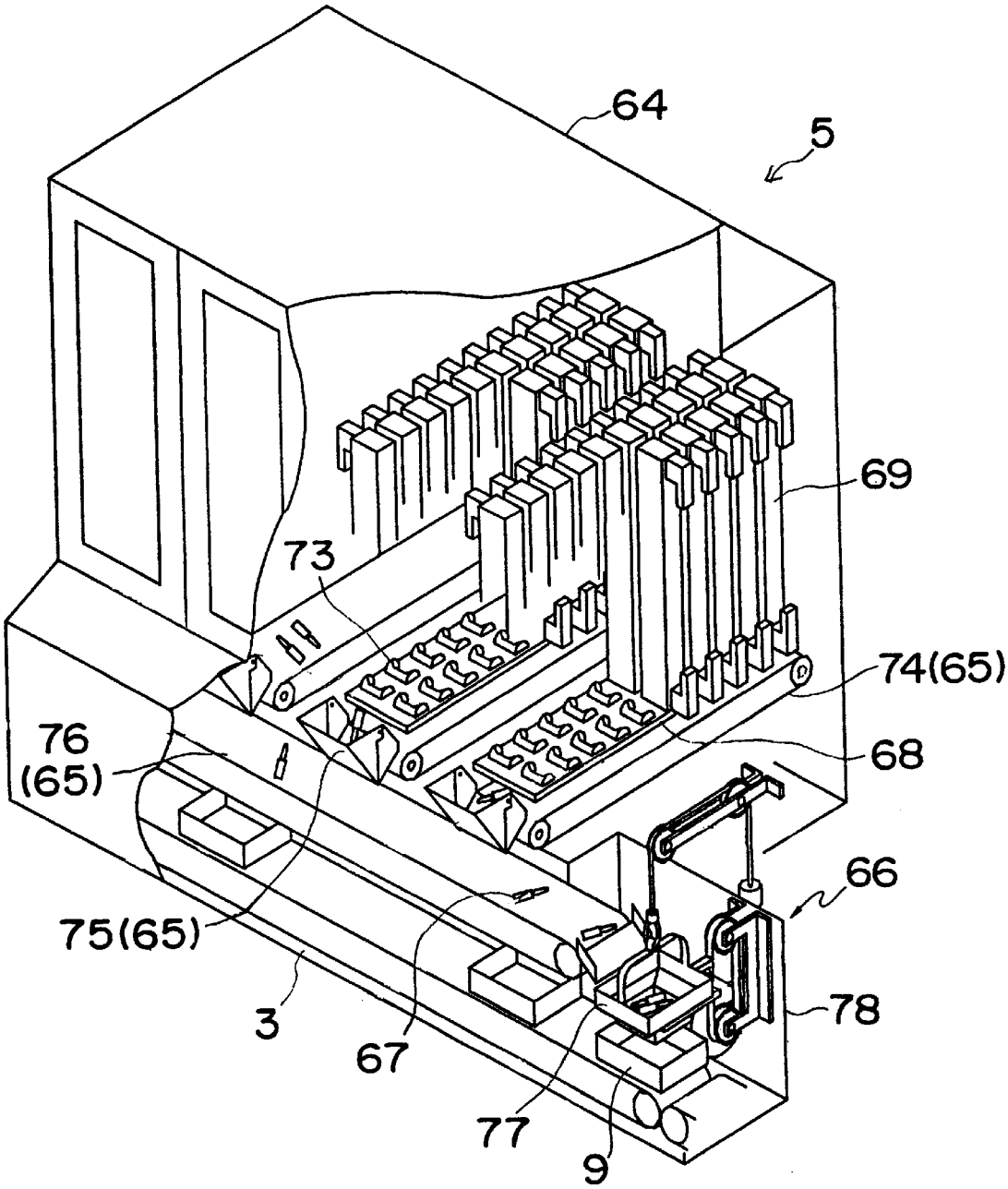
FIG. 10 is a partly broken perspective view showing the array ampoule dispensing station of FIG. 1.

The array ampoule dispensing station 5, as shown in FIG. 10, comprises an ampoule storage section 64, an ampoule conveying section 65 and an ampoule dispensing section 66, and is used mainly to dispense ampoules 67 each having a large capacity as much as 10 to 30 ml (for more details, see Japanese Patent Laid-Open Publication HEI 7-267370).

Figure 11A:
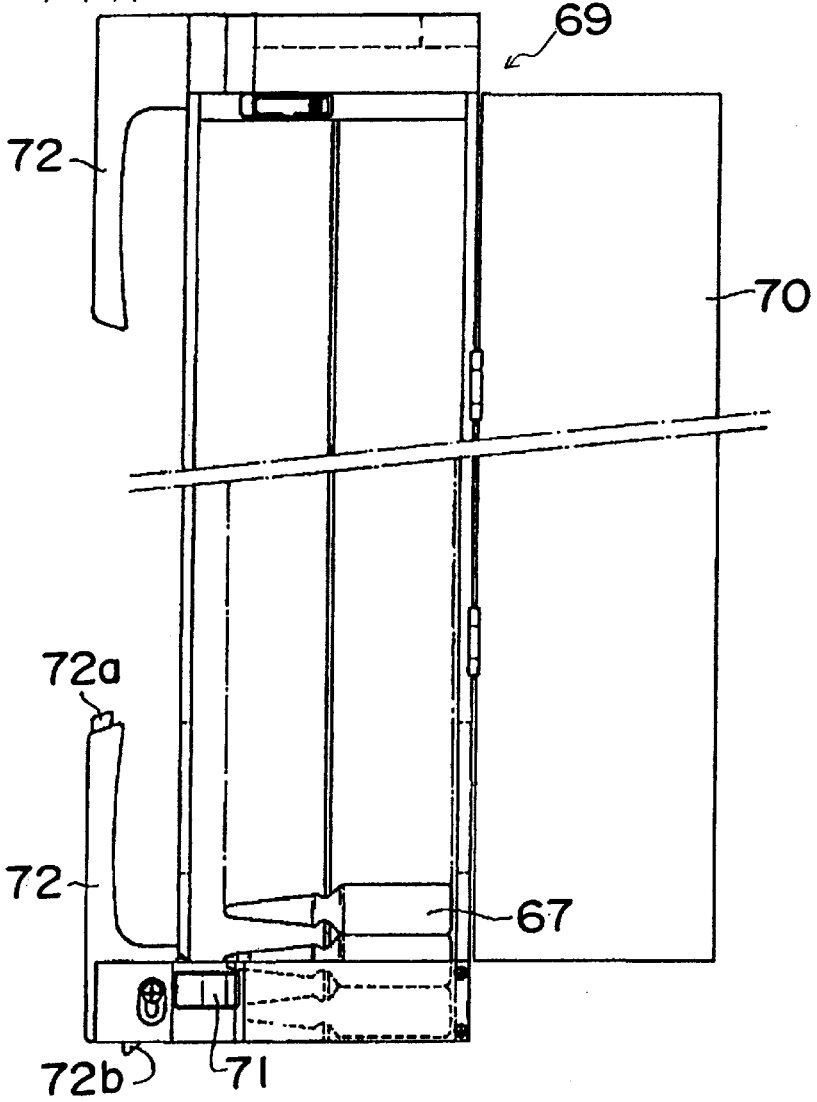
FIG. 11A is a front sectional view showing the ampoule cassette of FIG. 10.
Figure 11B:
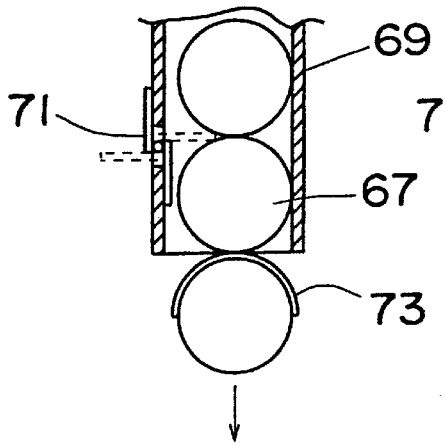
FIG. 11B is a partial sectional view showing an ampoule discharging state including a stop provided in a lowermost portion of the ampoule cassette.
Figure 11C:
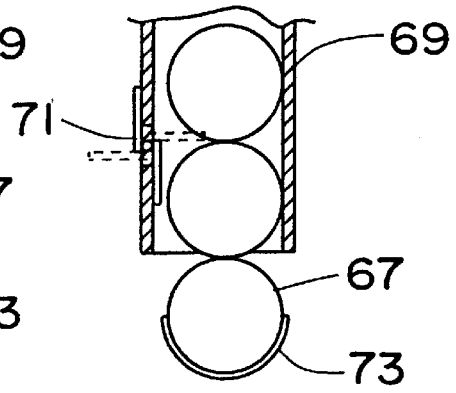
FIG. 11C is a partial sectional view showing an ampoule-holding state including the stop.

In the ampoule storage section 64, a plurality of drawer cradles 68 are provided in array. In each drawer cradle 68, a plurality of ampoule cassettes 69 are provided in array. Each ampoule cassette 69, as shown in FIG. 11A, is shaped into a box having an openable/closable door 70 provided on one side face, and in its interior, the ampoules 67 are stored in a laterally-postured and arrayed state. Also, as shown in FIGS. 11B and 11C, the lower face of the ampoule cassette 69 is opened, where a stop 71 is provided at the opening so as to prevent the ampoules 67 from falling off. When the ampoule cassette 69 is set up, only the lowermost-positioned ampoule 67 can be discharged out downward by withdrawing of stop 71. Further, handles 72 each protruding in a generally L shape are formed above and below on one side face of the ampoule cassette 69 perpendicular to the door 70. Detent activator portion 72*a* is formed in the lower handle 72, so that an engaging detent 72*b* provided at the lower end surface of the ampoule cassette 69 can be operated to extent and retract. By this engaging detent, the ampoule cassette 69 can be attached to the drawer cradle 68. The drawer cradle 68 is equipped with discharge rotors 73, and the ampoules 67 within the ampoule cassette 69 can be discharged one by one by the discharge rotor 73 pivoting between the states of FIGS. 11B and 11A. In addition, an insertion hole (not shown) intended for a sensor is bored in the lower-end side surface of the ampoule cassette 69, making it possible to detect that the remaining quantity of stock of the ampoules 67 has decreased or is lacking.

The ampoule conveying section 65 comprises a first conveyor belt 74 disposed below the drawer cradle 68, a stock storage 75 provided at the conveyance end of the first conveyor belt 74, and a second conveyor belt 76 disposed below the stock storage 75 generally perpendicular to the first conveyor belt 74.

The ampoule dispensing section 66 comprises a stock container 77 for storing conveyed ampoules 67, and an up-down member 78 for discharging the ampoules 67 stored in container 67 to the tray 9 on the conveyor line 3 while suppressing any impact force acting on the ampoules 67.

<Random Ampoule Dispensing Station>

Figure 12:
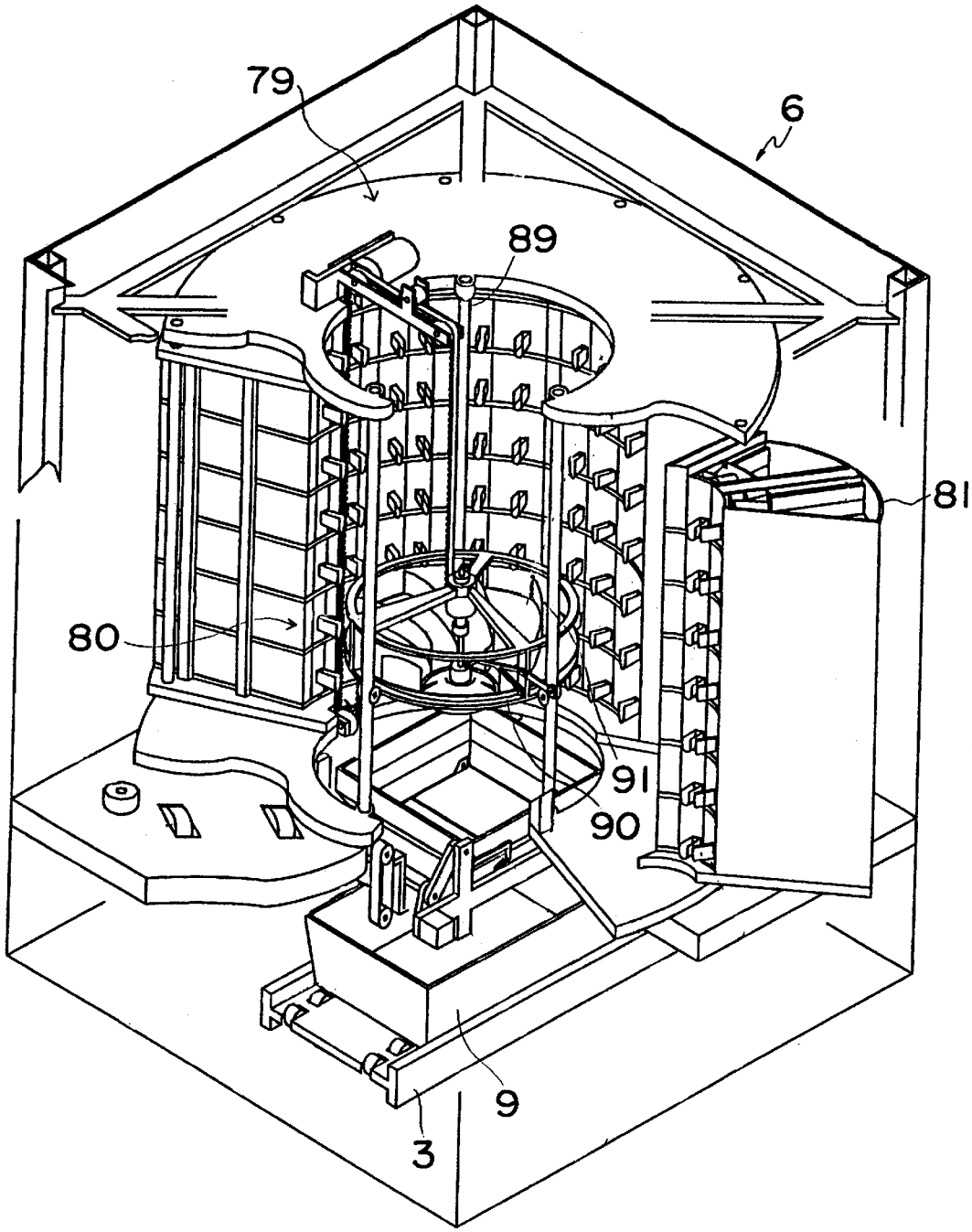
FIG. 12 is a partly broken perspective view showing the random ampoule dispensing station.

The random ampoule dispensing station 6, as shown in FIG. 12, comprises a drum-shaped rotary storage rack 79, and a lifter part 80 which goes up and down in the center of the rotary storage rack 79, and is used to dispense mainly small-capacity ampoules 81 (FIG. 13) with a capacity less than 10 ml (for more details, see Japanese Patent Applications HEI 10-149489, HEI 10-99001, HEI 9-142473, HEI 9-212102, etc.).

Figure 13A:
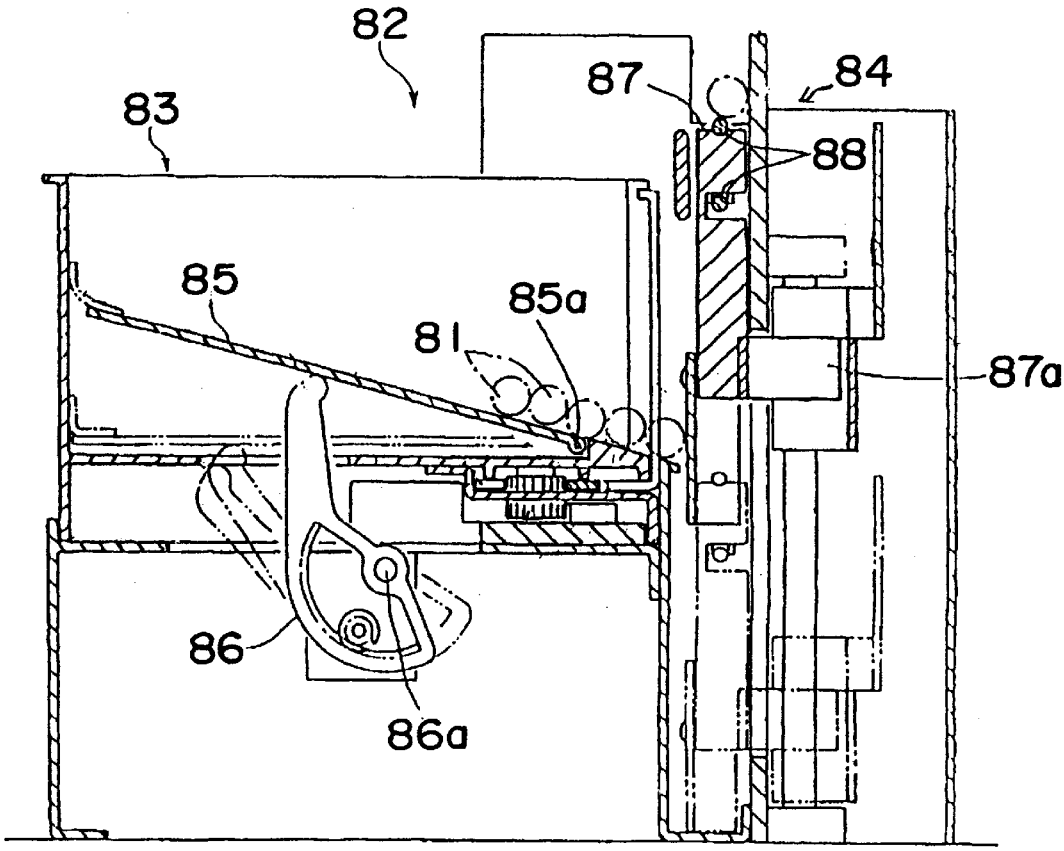
FIG. 13A is a front sectional view showing the ampoule container of FIG. 12.
Figure 13B:
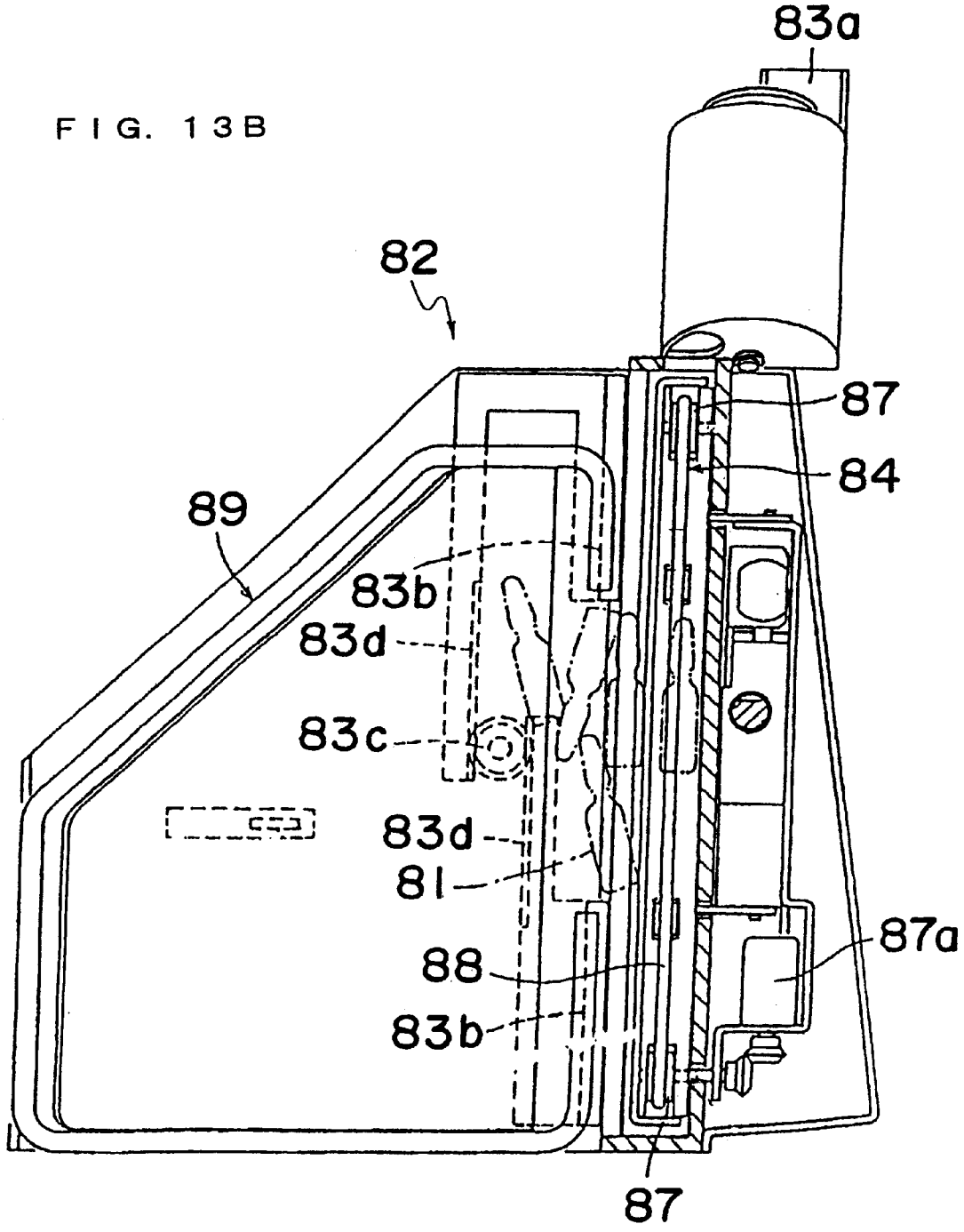
FIG. 13B is a top sectional view showing the ampoule container of FIG. 12.

In the rotary storage rack 79, a plurality of ampoule containers 82 are disposed vertically and circumferentially in so that an up-and-down space for the lifter part 80 can be obtained on the central side. Each ampoule container 82, as shown in FIGS. 13A and 13B, comprises an ampoule storage chamber 83 and an ampoule array-and-conveyance section 84.

A bottom wall 85 of the ampoule storage chamber 83 is pivotable about a pivot 85*a*, and will be inclined by rotation of a rotating arm 86 so that the ampoules 81 can be moved to the ampoule array-and-conveyance section 84. Also, in the ampoule array-and-conveyance section 84, a belt 88 is stretched between pulleys 87 so that the ampoules 81 placed on the belt 88 can be conveyed by one pulley 87 being rotated by the drive of a motor 87*a*. The ampoule array-and-conveyance section 84 can be moved up and down by the drive of a motor, between a lower position where the ampoules 81 within the ampoule storage chamber 83 can be loaded on, and an upper position where the ampoules 81 can be discharged to the lifter part 80 via a chute 83*a*. In addition, the ampoule storage chamber 83 and the ampoule array-and-conveyance section 84 are partitioned from each other by a shutter 83*b* which is opened and closed with a pinion 83*c* and a rack 83*d*.

Figure 14:
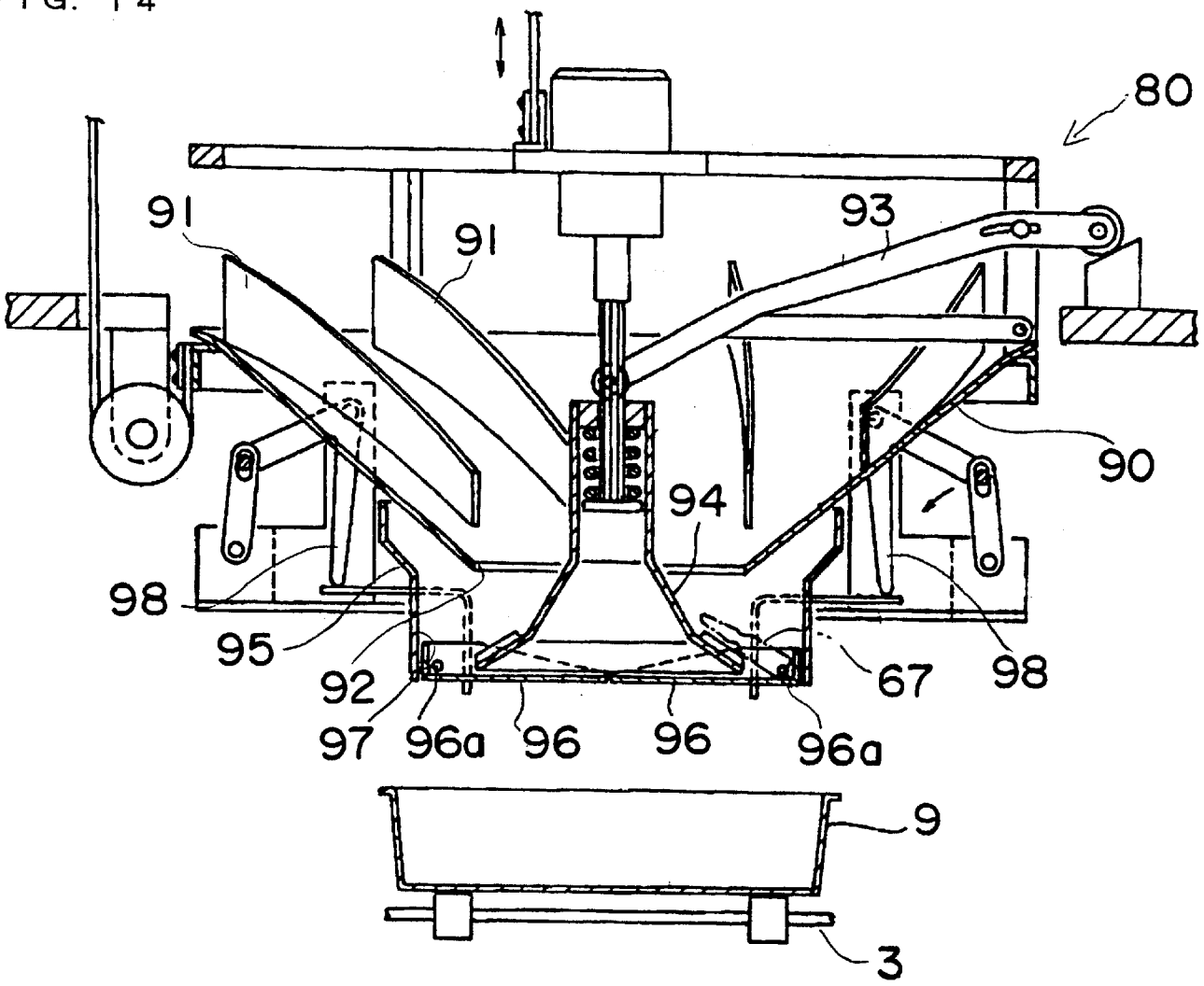
FIG. 14 is a sectional view showing the lifter part of FIG. 12.

In the lifter part 80, as shown in FIGS. 12 and 14, a lifter container 90 is moved up and down along three rails 89 provided vertically in a center-side space of the rotary storage rack 79 (for more details, see Japanese Patent Application HEI 9-71530). The lifter container 90 is funnel-shaped and has spiral guide blades 91 formed therein. The lifter container 90 is rotated by an unshown motor and leads a fed ampoule 67 to a central opening 92 under the guide of the guide blades 91. The opening 92 is opened and closed by an opening/closing valve 94 that is moved up and down with an opening/closing arm 93.

Figure 15A:
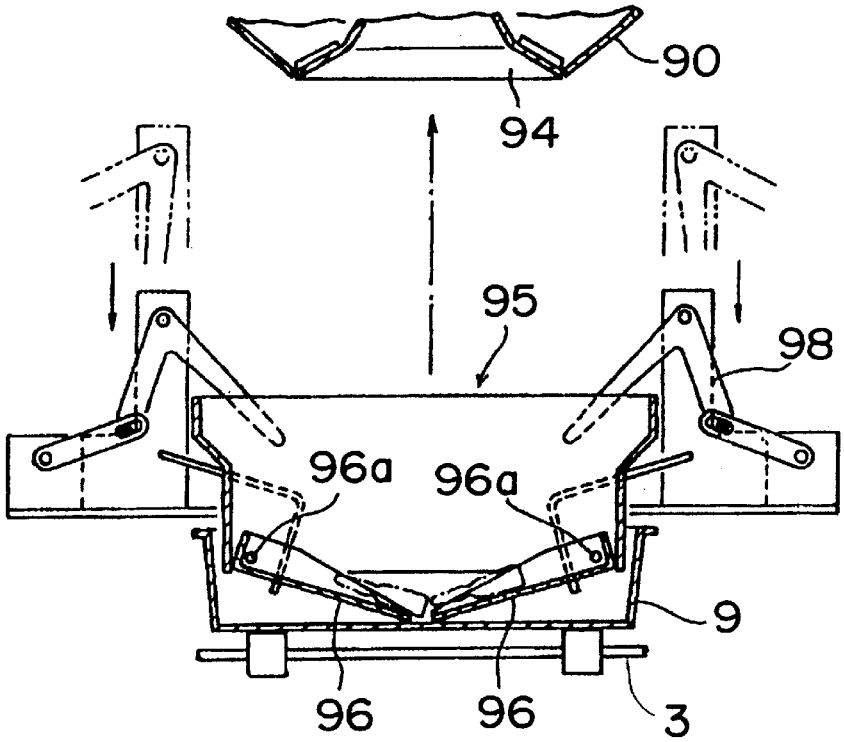
FIG. 15A is a sectional view showing the lifter container of the lifter part of FIG. 14 with its bottom plates released from the closed state.
Figure 15B:
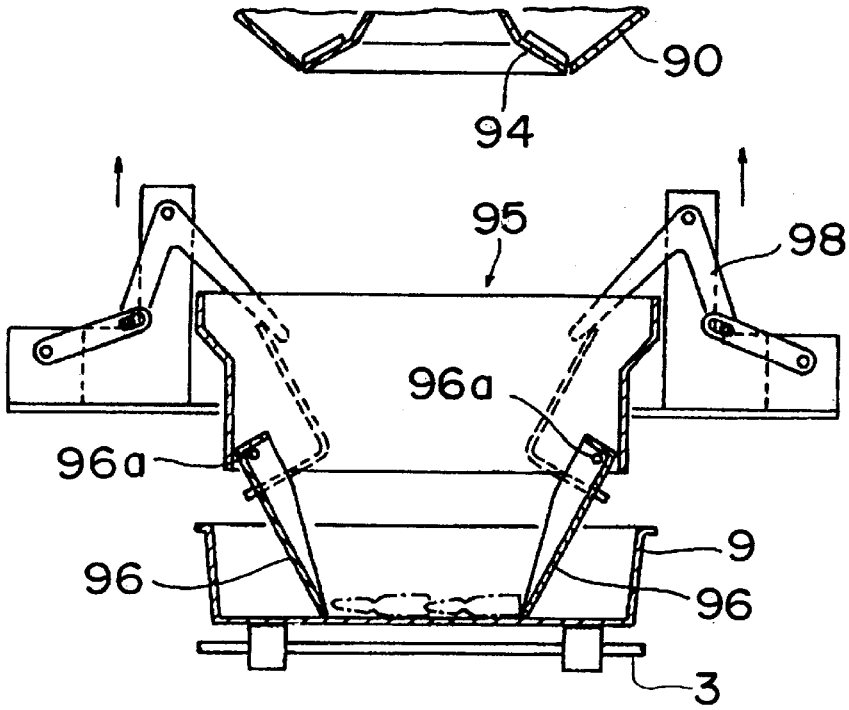
FIG. 15B is a sectional view showing a state in which the lifter container has been elevated from the position shown in FIG. 15A.

Below the lifter container 90, is provided a delivery stock storage device 95. In this delivery stock storage device 95, as shown in FIG. 15A, bottom plates 96 are provided into two divisions, right and left, each of which is pivotable about a pivot 96*a* to open a bottom-face opening 97. The bottom plates 96, as shown in FIG. 14, receive the ampoules 67 from the lifter container 90, and keep the bottom-face opening 97 closed by links 98 until the bottom plates 96 are located above and near the tray 9. Then, when the bottom plates 96 are located above and near the tray 9, the bottom plates 96 are released from the closed state by the links 98, as shown in FIG. 15A. As a result, when the lifter container 90 is moved up relative to the tray 9, the bottom plates 96 pivot while keeping their free end portions in contact with the top face of the tray 9, gradually opening the bottom-face opening 97 as shown in FIG. 15B. Accordingly, the ampoules 67 discharged from the lifter container 90 are smoothly moved into the tray 9 without undergoing any impact force.

<Label Issuing Station>

Figure 16:
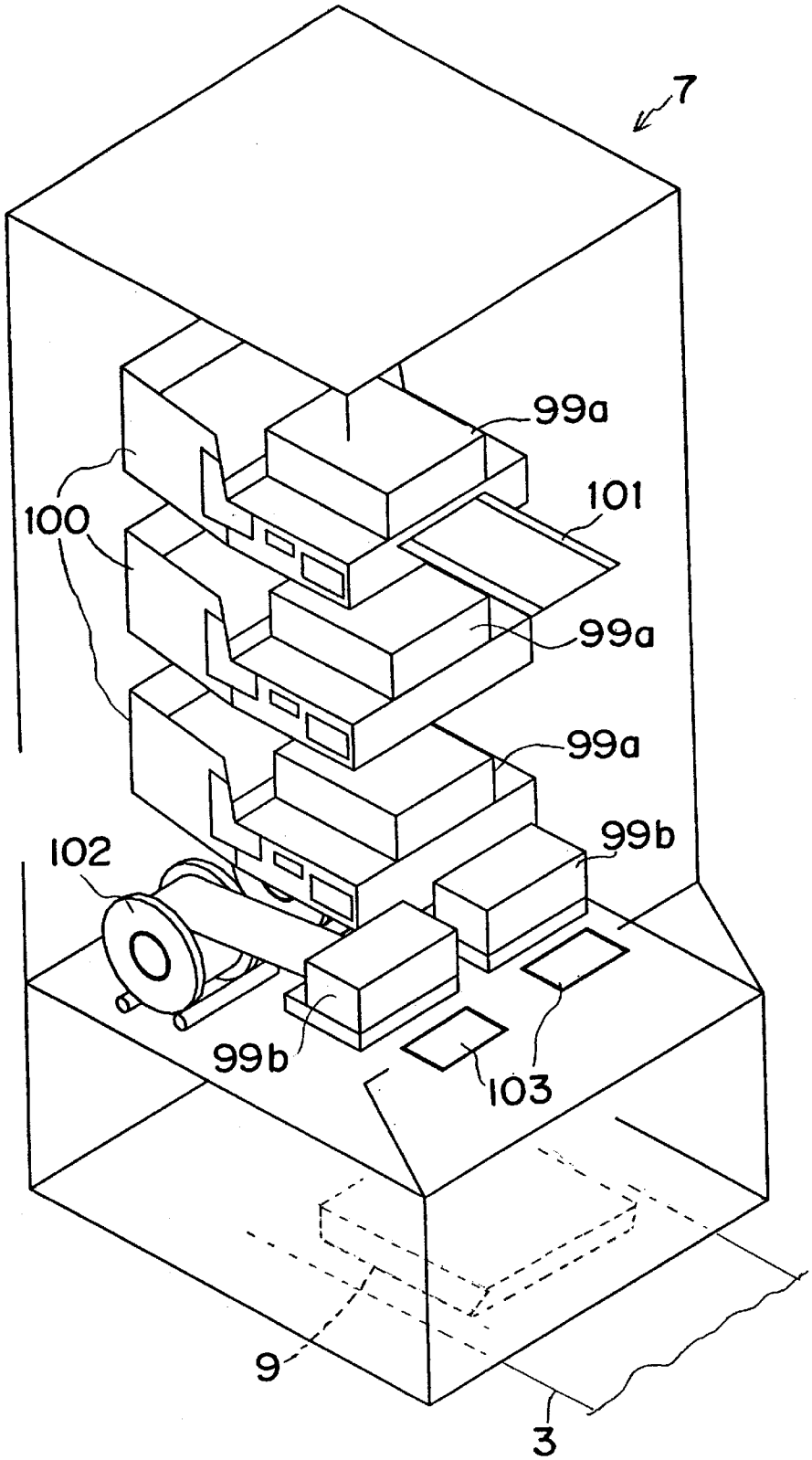
FIG. 16 is a schematic perspective view showing the label issuing station of FIG. 1.

The label issuing station 7 has a plurality of printers 99*a*, 99*b* arranged vertically as shown in FIG. 16, and the uppermost three printers 99*a* are fed with prescription paper 101 from stock storages 100, respectively. This prescription paper 101 is used for a pharmacist to later verify whether or not the dispensed medication is correct. Also, the printers 99*b* (shown juxtaposed below printers 99*a*) are each fed with a label 103 wound around a roll 102. This label 103 is affixed to the ampoules 67, storage containers or the like, and is used to indicate their contents.

<Tray Recovering Station>

Figure 17:
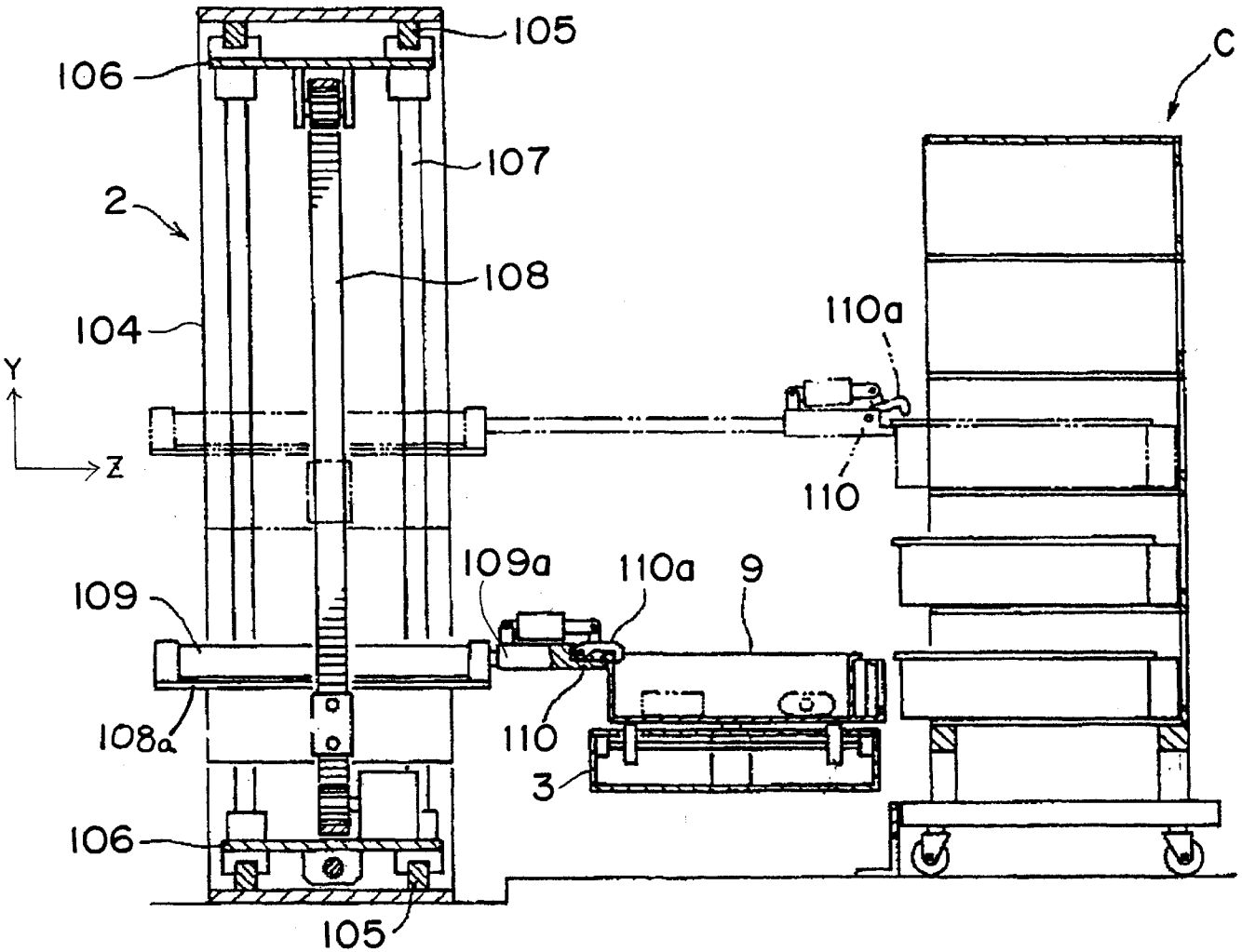
FIG. 17 is a sectional view showing the tray recovering station of FIG. 1.

In the tray recovering station 2, as shown in FIG. 17, a support base 106 is provided on rails 105 placed above and below in a support main frame 104 so that the support base 106 is reciprocatively movable along an X-axis direction parallel to the conveyor line 3. The support base 106 is equipped with guide rails 107 extending vertically. Base 108*a* is movable up and down along rails 107 by a belt chain 108 along a vertical Y-axis direction. Base 108*a* is equipped with a cylinder 109. Also, a rod 109*a* of the cylinder 109 is equipped with a gripping arm 110, which goes back and forth along a Z-axis direction perpendicular to the conveyor line 3. The gripping arm 110 has at i-s front end a claw portion 110*a* formed for gripping a peripheral portion of the tray 9 (see also Japanese Patent Laid-Open Publication HEI 9-51922 etc.).

<System Operation>

Next, operation of the medication collecting system constructed as described above is explained.

When patient prescription information is read, a tray 9 is fed out from the tray feed station 1 to the conveyor line 3. The tray 9 fed out to the conveyor line 3 is first conveyed to the tablet dispensing station 4. If information indicating that tablets 23 are not contained in the prescription information, then the tray 9 passes through the tablet dispensing station 4 without stopping. If such information is contained, the tray 9 is stopped below the sloped plate 57 of the distributing member 48.

For the prescription of the tablets 23, at the tablet dispensing station 4, one-day dose of medicaments are fed from the relevant tablet cassette 20 in steps of one dose one after another according to the dosage time, and then are packed into medication packages formed in the package belt 13.

Figure 18A:
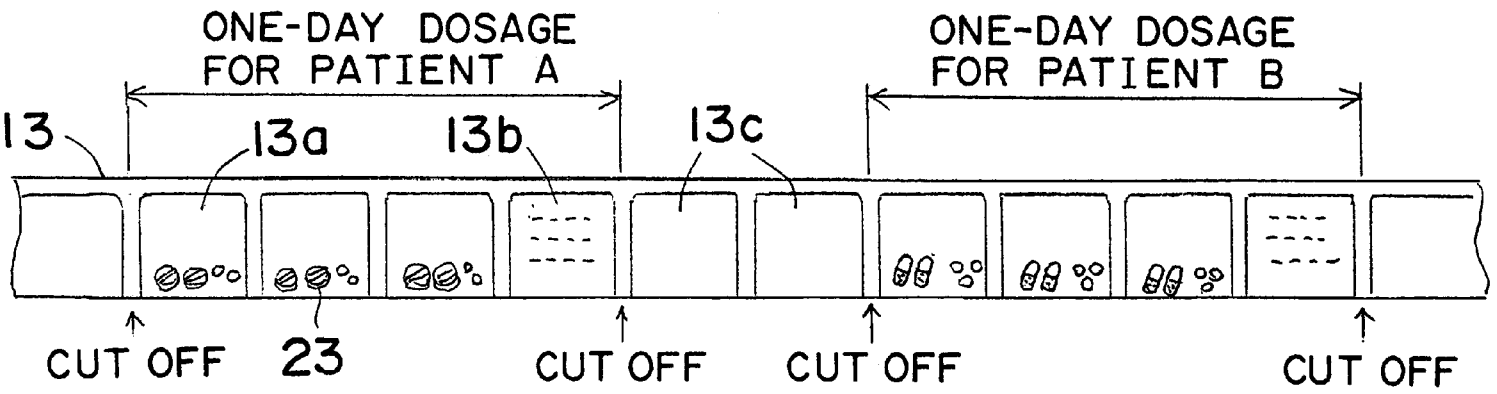
FIGS. 18A and 18B are front views showing examples of the package belt in which medicaments are packed.
Figure 18B:
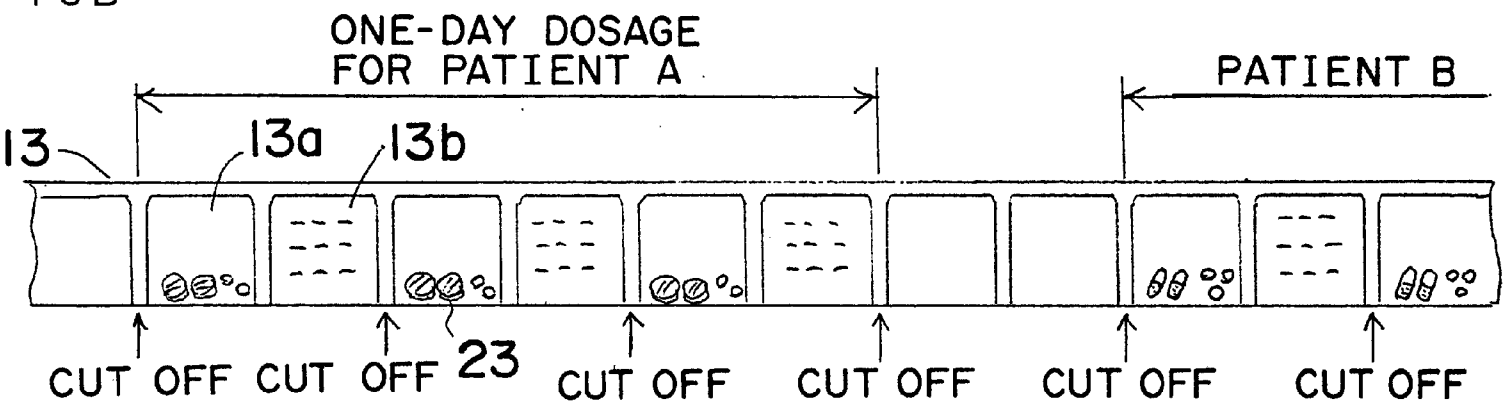

As for the form of package, if the one-day dosage includes a plurality of times, for example, morning, noon and evening, then medication packages 13*a* of the tablets 23 are continuously packaged as shown in FIG. 18A. Alternatively, empty packages are formed between the medication packages 13*a* of the tablets 23 and the contents of the tablets 23 dosage information and the like are printed on these empty packages to make printed portions 13*b* as shown in FIG. 18B. In the former case, as shown in FIG. 18A, the package belt is cut off by the cutter 29 with one-day doses taken as a unit. Thus, the need for bundling by the bundling machine 47 is eliminated. In the latter case, as shown in FIG. 18B, the package belt is cut off by the cutter 29 with one dose taken as a unit. In addition, with a different patient, two empty packages 13*c* are additionally formed between a printed portion 13*b* for patient A and a medication package portion 13*a* for the next patient B, thus enabling a continuous processing. Further, the empty packages 13*c* are separated from the other portions by the cutter 29.

Subsequently, the cut package belt 13 is conveyed to the inverting member 44 via the direction changing part 33 and the conveyor 34, so as to be transferred to the lifter 45. For the package belt 13 or the empty packages 13*c* in the unit of one-day doses, the lifter 45 goes up without waiting for stacking by the transfer from the inverting member 44; for the package belt 13 in the unit of one dose, the lifter 45 will not go up until one-day doses has been completely stacked by the transfer from the inverting member 44. Then, the cut package belt 13 is moved sideways by the feed-in member 46, where in the case of the package belt 13 or empty packages 13*c* in the unit of one-day doses, the cut package belt 13 is passed through as it is without being bundled by the bundling machine 47; in the case of the stacked package belt 13, the cut package belt 13 is once stopped at the bundling machine 47, where the cut package belt 13 is bundled and then fed to the tray 9 via the distributing member 48. In addition, in the distributing member 48, for processing's sake, when empty packages 13*c* are conveyed up, the empty packages 13*c* are discarded to the dust box 63 via the opening 58 by rotating the distributing plate 59.

Subsequently, the tray 9 is conveyed to the array ampoule dispensing station 5, and further to the random ampoule dispensing station 6. In this case also, based on the prescription information, the tray 9 is passed through as it is, or when ampoules 67, 81 are fed, the tray 9 is stopped at a relevant unit.

After that, the tray 9 is conveyed to the label issuing station 7. In the label issuing station 7, the prescription paper 101 on which prescription information as to all the medicaments within the conveyed-up tray 9 has been printed, as well as a label 103 to be affixed to the surface to show the contents of the stored ampoules 67 are fed into the tray 9.

Now that desired medicaments have been fed to the tray 9 in this way, this tray 9 is conveyed to the tray recovering station 2, where the medicaments are transferred onto shelves of a sorting cart (e.g., medication storage cabinet marketed by Pyxis Co.) C by the arm 110. In addition, this sorting cart C is movably set in the nurse station, and put into use for distribution to the patients in hospital when administration time has come.

<Medication Replenishment Operation>

Whereas the dispensing of medication is carried out as described above, the medication collecting system is enabled to detect the absence of the tablets 23, the ampoules 67, 81, and to perform appropriate replenishment by checking these medicaments.

For this purpose, the tablet dispensing station 4 and the ampoule dispensing stations 5, 6 are equipped, although not shown, with a touch panel to be controlled by a controller, a wireless barcode reader with a recharging cradle therefor, and a scale.

Figure 19B:
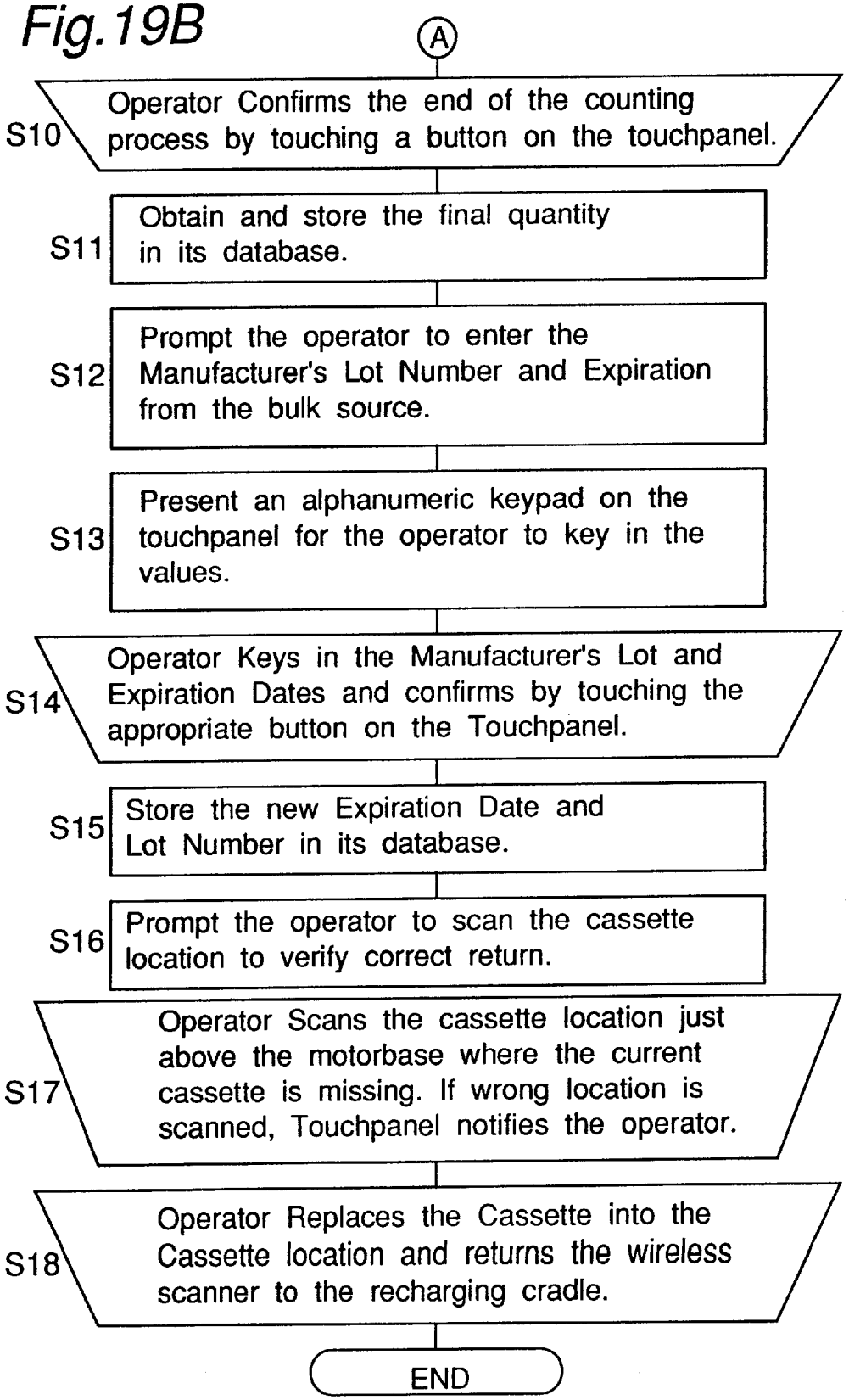

In the tablet dispensing station 4, the tablet cassettes 20 are exchanged according to the flow charts of FIGS. 19A and 19B. That is, when specified tablets 23 have come out of stock so that an empty tablet cassette 20 is detected (step S1), the cylindrical drum 18 is rotated so that the empty tablet cassette 20 is moved to an interchangeable position, where its cassette number is notified, followed by a standby state (step S2). Also, a relevant medication profile is loaded from the database, and the current inventory count and expiration dates/lot numbers are displayed on the touch panel (step S3). Then, the operator obtains a wireless barcode scanner (step S4), reads the barcode of this tablet cassette 20, verifying tablets 23 to be replenished (step S5). In this process, if the selected tablet cassette 20 is other than one containing the correct tablets 23, the operator is informed of an error by the touch panel.

Subsequently, the operator places the empty tablet cassette 20 on the scale, where if the operator presses the "Tare" button on the touch panel (step S6), then the scale is initialized, prompting the operator to operate the bulk bottle for verification (step S7). If the verified bulk bottle is erroneous, the result is displayed on the touch panel, by which the operator is reported of it. If the verification result is correct, then the operator is prompted to pour in a desired quantity of medication into the scale. Then, if the operator has poured oral medication into the tablet cassette 20 on the scale (step S8), the scale counts the total medications poured into the tablet cassette 20 (step S9). In this case, if too much medication is poured in, a warning is presented on the touch panel.

Next, the operator operates a button on the touch panel, where if an end of the counting process is confirmed (step S10), then the final quantity is stored in the database (step S11). Subsequently, the operator is prompted to enter the manufacturer's lot number and expiration date according to the indication on the bulk bottle (step S12). Also, an alphanumeric keypad is displayed on the touch panel for the operator to key in values (step S13). If the operator has keyed in the manufacturer's lot number and expiration date and confirmed by touching an appropriate button on the touch panel (step S14), then the database is updated so that the lot number and expiration date are rewritten to the new ones (step S15).

After that, in order to verify a correct return place for the replaced tablet cassette 20, the operator is prompted to scan the barcode of cassette location (step S16), and this is displayed on the touch panel. The operator sets a new tablet cassette 20 according to this instruction, where the operator scans the barcode of the cassette location provided just above the motor base 19 with no tablet cassette 20 set. If a barcode of a wrong position is scanned, this fact is displayed on the touch panel so that the operator is notified of it (step S17). With these steps of work completed, the operator sets the tablet cassette 20 to the motor base 19 in the corresponding position, and returns the wireless scanner to the original position (step S18).

Figure 20A:
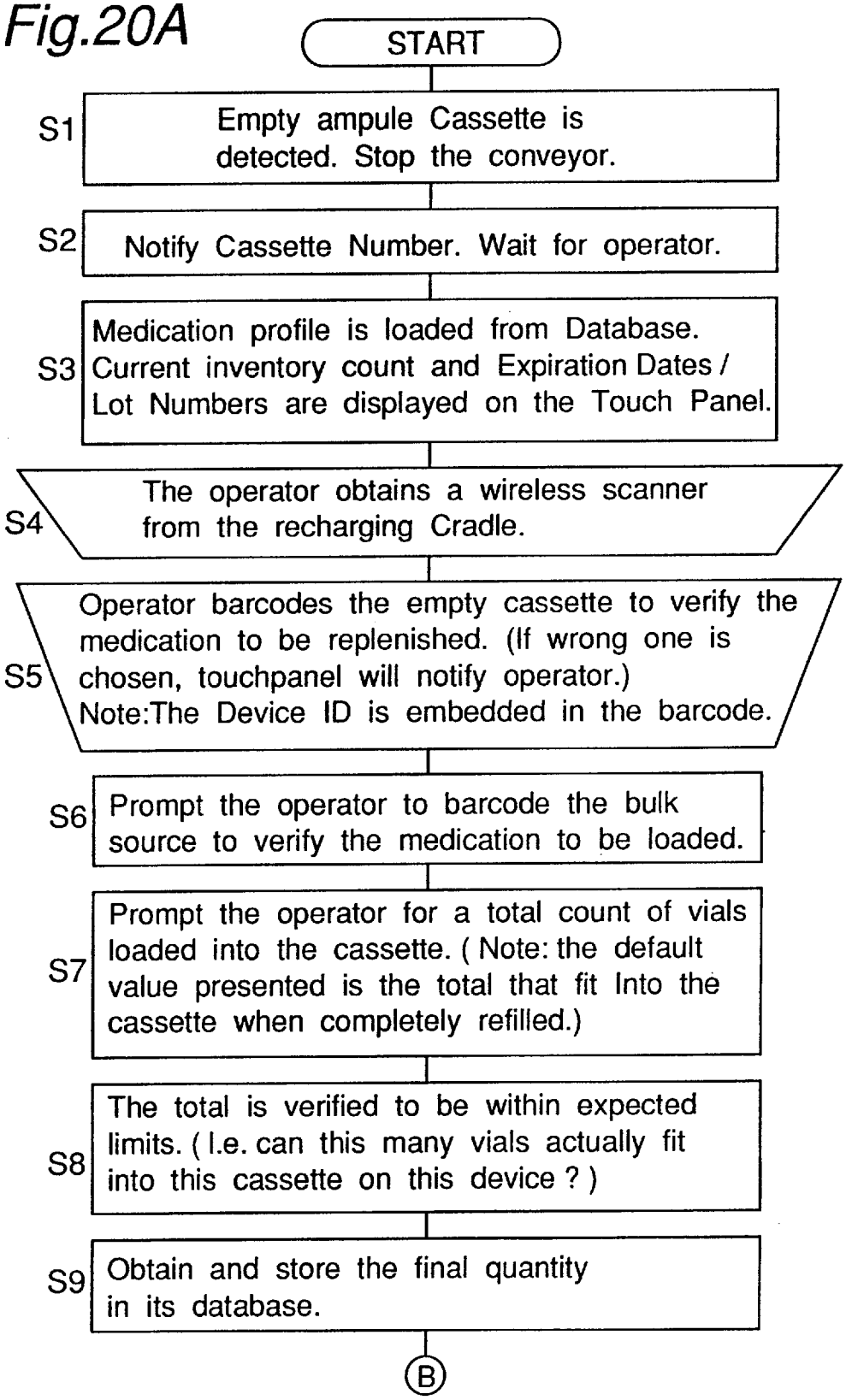
FIGS. 20A and 20B are flow charts showing the ampoule replenishing work in the array ampoule dispensing station or random ampoule dispensing station.
Figure 20B:
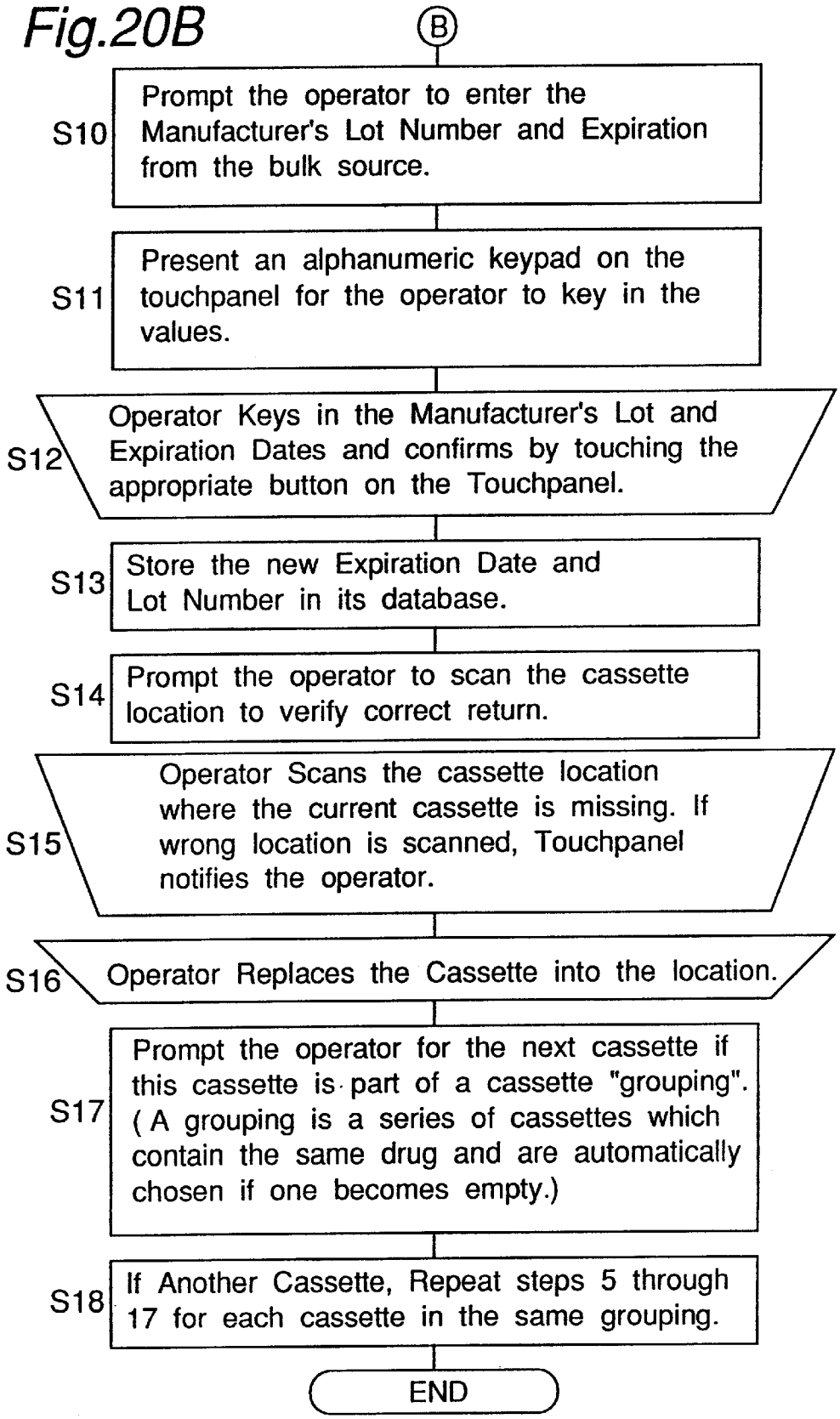

It is noted that, also for the ampoule cassettes 69 and the ampoule containers 82, the processes described above are carried out similarly according to the flow charts shown in FIGS. 20A and 20B.

<Consumables Management Operation>

Also, in this medication collecting system, even consumption state of consumable articles (printing ink, package belt and the like) in the units can be detected.

For example, the remaining quantity of the package belt 13 which is used in the tablet dispensing station 4 is calculated based on an initial length and a length required per package. Similarly, the remaining quantity of the band set to the bundling machine 47 which is used in the tablet dispensing station 4 is calculated based on an initial length and a band feed quantity. Further, remaining quantity of the prescription paper 101 which is used in the label issuing station 7 is calculated by subtracting the number of printed sheets from the initial setting number of sheets each time a printing process is performed. The remaining quantity of thermal transfer ink ribbon which is used in the label issuing station 7 is calculated based on an initial length and a consumption length (the consumption length for six-line printing is 3.5 mm).

Each time the consumption state of each consumable article is detected in this way, consumable article data is updated, where it is decided whether or not the article needs to be replaced. If it is decided that the article needs to be replaced, then an instruction that, for example, "Package paper will soon be out. Do you want to replenish?", and "YES/NO" keys are displayed on the display as a replenishment operating screen. If the "YES" key is chosen, then replacement procedure for the relevant consumable article is displayed. Then, the article is replaced according to this procedure, and if the replacement is completed, a question, "Has replacement been completed?", and "YES/NO" keys are automatically displayed. If the "YES" key is chosen, the replenishment operating screen is ended and consumable article data is updated, followed by a return to the normal screen.

<Automatic Bagging Station>

Figure 21:
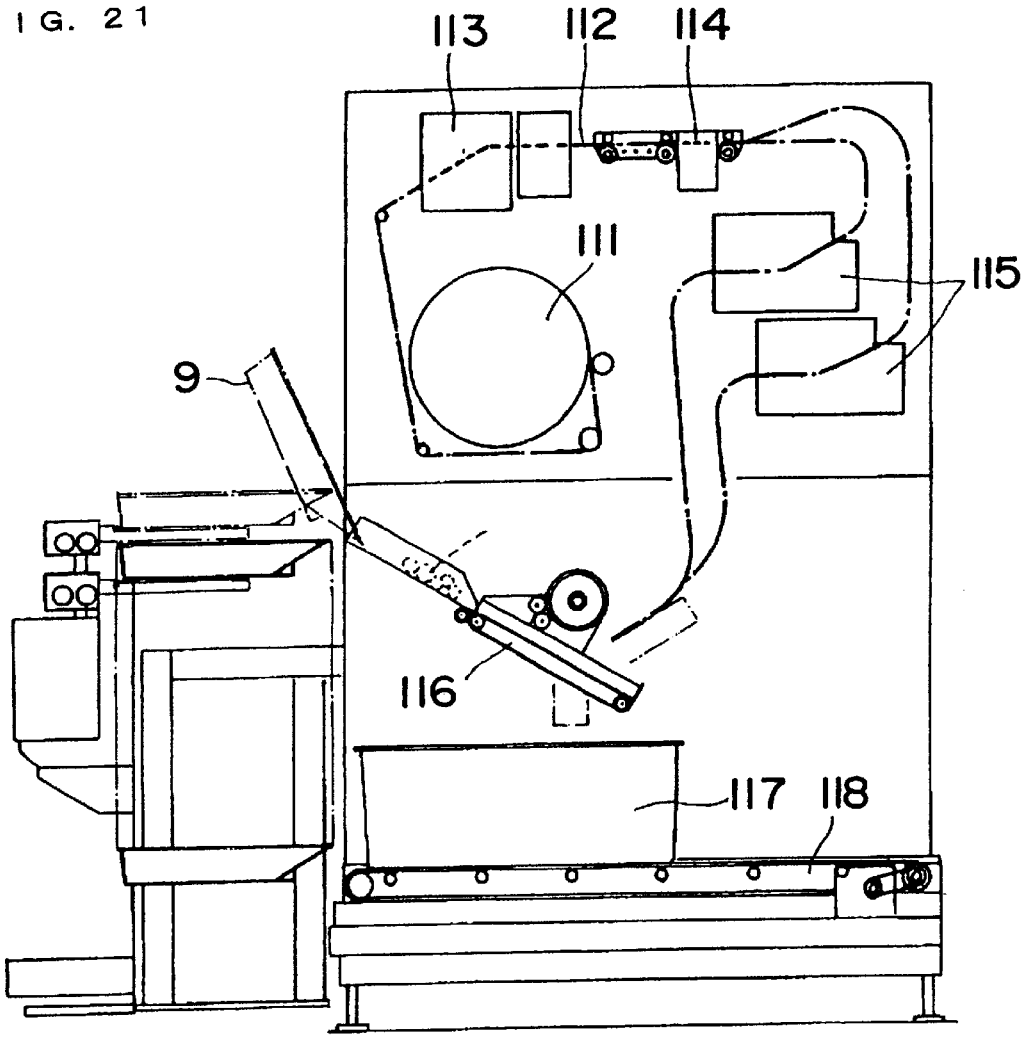
FIG. 21 is a schematic sectional view of an automatic packing station that can be provided instead of the tray recovering station of FIG. 17.

Whereas the tray recovering station 2 is provided in the above-described embodiment, an automatic bagging station shown in FIG. 21 may be adopted instead (for more details, see Japanese Patent Applications HEI 10-203749, HEI 10-75813, etc.).

In this automatic bagging station, a sheet 112 wound around a roll 111 is formed into a bag shape by a sealing part 113 and cut into bags by a cutter 114, and the bags are printed on the surfaces by a printer 115 and then conveyed to a medication feed part 116. In the medication feed part 116, with the bags opened, medicaments within the tray 9 are all put into the bags, and after sealing, the bags are accommodated in a large-size tray 117 provided below the medication feed part 116. The large-size tray 117 is conveyed sideways by a conveyor 118.

Although an embodiment of the present invention has been described above with reference to the accompanying drawings, modifications and changes apparent for those skilled in the art may be made in various ways. It is needless to say that these modifications and changes should be construed as being included in the present invention unless they depart from the spirit or scope of the invention.

We claim:

1. A medication collecting system comprising:

means for accumulating a plurality of empty trays, the trays provided for receiving patient-specific medication from at least one dispensing station and for supplying the trays to a conveyor line;

at least one medication dispensing station disposed along the conveyor line having means for storing a plurality of different types of oral solid medication and means for dispensing and packaging the medication in packaged, patient-specific medication dosage-units formed in a package belt in accordance with patient-specific prescription information and means for discharging the packaged medication to a patient-specific tray transported by the conveyor line to the dispensing station, the medication dispensing station further having:

means for cutting the package belt into each section including at least one medication package in accordance with the patient-specific prescription information;

stacking means for stacking the cut package belt sections for each patient in accordance with the patient-specific prescription information; and bundling means for bundling the stacked package belt sections in accordance with the patient-specific prescription information;

means for recovering and sorting the trays containing the patient-specific package belt sections discharged from the at least one medication dispensing station.

2. The system of claim 1 wherein the medication dispensing station further includes means for organizing and discharging the cut package belt sections corresponding to the day the medication is to be taken by the patient.

3. The system of claim 1 wherein the medication dispensing station further includes means for organizing and discharging the cut package belt sections corresponding to the dosage-units to be taken at a particular time by the patient.

4. The system of claim 1 wherein each discrete package belt section cut by the cutting means includes at least one empty package on which information is printed and at least one package containing a dosage-unit of medication.

5. The system of claim 4 wherein the empty, printed package is not included in the stack with the packages containing the dosage-unit of medication.

6. The system of claim 1 wherein the medication dispensing station further includes:

means for separating empty packages from the bundled package belt sections; and means for directing the bundled package belt sections from the separating means to a tray transported along the conveyor line.

7. The system of claim 1 further comprising at least one liquid medication dispensing station for storing a plurality of different types of liquid medication contained in ampoules, and for dispensing the ampoules into a tray in patient-specific dosage-units in accordance with the patient-specific prescription information comprising:

means for storing a plurality of liquid medication ampoules;

means for dispensing the stored ampoules; and means for discharging the ampules into at least one patient-specific tray fed to the conveyor line from the tray feed station.

8. A medication collecting system, comprising:

a tray feed station for accumulating a plurality of empty trays for receiving patient-specific medication from at least one dispensing station and supplying the trays to a conveyor line;

a medication dispensing station disposed along the conveyor line for storing a plurality of different types of oral solid medication and for dispensing the medication in packaged, patient-specific medication dosage-units in accordance with patient-specific prescription information to a patient-specific tray transported by the conveyor line to the dispensing station, the medication dispensing station having:

a plurality of oral solid medication storage containers, each container having an opening through which the medication is discharged in a controlled manner;

dispensing apparatus for dispensing oral solid medication from the medication storage containers in patient-specific dosage-units in accordance with the patient-specific prescription information;

a packaging mechanism for packaging the oral solid medication in separate medication packages formed in a packaging belt, each medication package representing a patient-specific medication dosage-unit;

a cutting mechanism for cutting the package belt into predetermined discrete sections, each section including at least one medication package in accordance with the patient-specific prescription information;

a stacking mechanism for stacking the cut package belt sections for each patient; and a bundling mechanism for bundling the stacked package belt sections; and a tray recovery station for recovering and sorting the trays containing the patient-specific package belt sections discharged from the medication dispensing station.

9. The system of claim 8 wherein the medication dispensing station organizes and discharges the cut package belt sections corresponding to the day the medication is to be taken by the patient.

10. The system of claim 8 wherein the medication dispensing station organizes and discharges the cut package belt sections corresponding to the dosage-units to be taken at a particular time by the patient.

11. The system of claim 8 wherein each discrete package belt section cut by the cutting mechanism includes at least one empty package on which information is printed and at least one package containing a dosage-unit of medication.

12. The system of claim 11 wherein the empty, printed package is not included in the stack with the packages containing the dosage-unit of medication.

13. The system of claim 8 wherein the medication dispensing station further includes:

a separator mechanism for separating empty packages from the bundled package belt sections; and an inclined distributing member for directing the bundled package belt sections from the separator mechanism to a tray transported along the conveyor line.

14. The system of claim 8, further comprising at least one liquid medication dispensing station for storing a plurality of different types of liquid medication contained in ampoules, and for dispensing the ampoules into a tray in patient-specific dosage-units comprising:

a plurality of liquid medication storage containers, each container having a first end through which the ampoules are discharged in a controlled manner;

dispensing apparatus for dispensing the ampoules from the storage containers; and a discharge mechanism for discharging the ampoules into at least one patient-specific tray.

* * * * *

UNITED STATES PATENT AND TRADEMARK OFFICE

CERTIFICATE OF CORRECTION

PATENT NO. : 6,170,230 B1
DATED : January 9, 2001
INVENTOR(S) : Duane S. Chudy et al.

It is certified that error appears in the above-identified patent and that said Letters Patent is hereby corrected as shown below:

Title page,
Following "Medical Packaging Inc., "AutoPakTM" -A Fully Automated Unit Dose Packaging System" undated." delete "undated." and insert --. Date: Not later than December 3, 1997, probably 1996. --

Following "Baker APS, Expand Your Pharmacy's Potential with the Total Automation Starter Kit from Baker APS" undated." delete "undated." and insert -- Date: Not later than December 3, 1997 probably 1995. --

Following "Innovation Associates, "PharmASSIST Order Entry Manual Filling..." undated. delete "undated." and insert --. Date: Not later than December 3, 1997, probably August 1997. --

Following "Tosho, "Tosho Main-Topra Series PC-Cat" undated in the English-language." insert -- Date: Not Later than December 3, 1997, probably 1993. --

Following "Baker APS, "Baker The Pharmacy Productivity Company-Pharmacy 1000" undated." delete "undated." and insert --. Date: Not Later than December 3, 1997, probably June 1997. --

Following "Sanyo, "AIC-RNC7/RNV7" undated in the English language." insert -- Date: Not Later than December 3, 1997, probably early 1990's. --

Following "Yuyama Mfg. Co., Ltd., Yuyama catalog date uncertain, possibly 1995 (see second page)." delete "date uncertain, possibly 1995 (see second page)." and insert --. Date: Not later than December 3, 1997, probably 1995 or earlier. --

UNITED STATES PATENT AND TRADEMARK OFFICE

CERTIFICATE OF CORRECTION

PATENT NO. : 6,170,230 B1
DATED : January 9, 2001
INVENTOR(S) : Duane S. Chudy et al.

It is certified that error appears in the above-identified patent and that said Letters Patent is hereby corrected as shown below:

Column 1,
Line 49, insert -- . -- after "dispensary".
Line 50, insert -- The -- before "medication."

Column 6,
Line 53, change "extent" to -- extend --.

Column 8,
Line 26, change "i-s to -- its --.

Signed and Sealed this

Eighteenth Day of December, 2001

*Attest:*

*Attesting Officer*

JAMES E. ROGAN
*Director of the United States Patent and Trademark Office*